US006773180B2

(12) United States Patent
Tsuji et al.

(10) Patent No.: US 6,773,180 B2
(45) Date of Patent: Aug. 10, 2004

(54) IMAGE RECORDING APPARATUS

(75) Inventors: Masaaki Tsuji, Wakayama (JP); Togo Kinoshita, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 10/404,066

(22) Filed: Apr. 2, 2003

(65) Prior Publication Data

US 2003/0189629 A1 Oct. 9, 2003

(30) Foreign Application Priority Data

Apr. 4, 2002 (JP) ..... 2002-102510
Apr. 4, 2002 (JP) ..... 2002-102511
Apr. 26, 2002 (JP) ..... 2002-125446

(51) Int. Cl.[7] ..... B41J 3/62; B41J 11/70

(52) U.S. Cl. ..... 400/608.4; 400/605; 400/607; 400/609; 400/621

(58) Field of Search ..... 400/621, 604, 400/605, 607, 607.3, 608, 608.1, 608.4

(56) References Cited

U.S. PATENT DOCUMENTS 5,452,050 A * 9/1995 Ishikawa et al. ..... 355/27
6,168,324 B1 * 1/2001 Lever et al. ..... 400/82
6,538,715 B2 * 3/2003 Beggiao ..... 355/28
2001/0035978 A1 11/2001 Sugaya et al.

FOREIGN PATENT DOCUMENTS

JP 5-278930 A 10/1993
JP 2002-19214 A 1/2002

* cited by examiner

*Primary Examiner*—Daniel J. Colilla
(74) *Attorney, Agent, or Firm*—Smith Patent Office

(57) ABSTRACT

When images in the order of photographing are printed on papers being conveyed in parallel, the images are allotted to each paper such that the order of an image to be printed in a predetermined order from the leading end of the paper closer to a tray is one smaller than that of the other paper, and the order of images to be printed on each paper gradually increase by twos toward the tail end of each paper. The papers cut with a cutting unit after each image is printed are conveyed with a conveyor belt and piled on the tray in the order of photographing.

25 Claims, 25 Drawing Sheets t = T3 t = T6 t = T7

IMAGE RECORDING APPARATUS

BACKGROUND OF THE INVENTION

1. Field of the Invention

The present invention relates to image recording apparatus capable of recording images on record media being conveyed in parallel with each other.

2. Description of Related Art

As an ink-jet printer for printing by ejecting liquid ink onto a paper, there is known a printer in which a paper roll formed by rolling a long paper is installed and images are printed in sequence with a printing head on the paper being taken out from the roll. Image data to be recorded may include images different in length from each other in the order of photographing for example.

In such a printer, printing may be performed substantially at the same time onto two relatively narrow papers disposed in parallel with each other in order to improve the processing performance of the printer. In this case, images different in length from each other are printed in sequence with being properly allotted to each of the two papers disposed in parallel. In many cases, such a printer is provided with a cutting unit including a long guillotine cutting edge extending over the two papers disposed in parallel. The printer thereby can cope with a case wherein a wide paper is conveyed in a single line.

In case of cutting a long paper into a predetermined length before an image is printed thereon, since the vicinity of the leading edge of the paper disposed to be opposite to a printing head may separate from the supporting face for the paper, the flatness of the print surface in the vicinity of the leading edge of the paper may not be ensured. In this case, the image printed in the vicinity of the leading edge of the paper may be bad. In case that printing is performed at a relatively high speed to the vicinity of the leading edge of the paper, the image printed in the vicinity of the leading edge of the paper is apt to be uneven, so the image is apt to be bad. Therefore, it is desirable to perform printing at a relatively low speed to the vicinity of the leading edge of the paper. In this case, however, the processing performance of the printer is lowered. Consequently, in such a printer, it is preferable that a long paper is cut at the tail end of each image after the image is printed.

In such a printer, two papers disposed in parallel are cut at the rear end of each image independently of each other or substantially at the same time. The papers are then discharged from the printer or conveyed in a direction perpendicularly to the conveyance direction before printing. In some cases, they are piled together. In the existing circumstances, however, such a printer is not so designed as to convey or pile, after printing, printed papers in the order of photographing of images printed thereon. Therefore, the papers being conveyed or piled after printing must be rearranged in the order of photographing.

When images different in length start at the same time to be printed on two papers disposed in parallel, the positions of the rear ends of the two images are not the same. Therefore, in case of cutting the papers with a cutting unit including a long guillotine cutting edge extending over the two papers disposed in parallel, if one paper is cut at the rear end of a printed image, the other paper is cut in the middle of a printed image or with a margin where no image is printed.

Therefore, to cut the two papers disposed in parallel at the rear ends of two images with such a cutting unit without wasting the papers and cutting a margin provided after the rear end of an image, the two papers must be cut independently of each other a the rear ends of the images. As a result, the number of cuts with the cutting unit is substantially the same as the number of printed images. Thus, in this case, the number of cuts with the cutting unit is inevitably large. In many cases, the life of such a guillotine cutting unit as described above is determined by the number of cuts. For example, the cutting performance of the unit for paper deteriorates as the number of cuts increases. Besides, in case of cutting two papers independently, "cut the air" (cutting edges cross each other in a state that there is no paper) occurs in a portion corresponding to the conveyance path for the paper not to be cut with the guillotine edge of the cutting unit. In case of "cut the air" with the guillotine cutting edge, when both edges cross each other, the wear of each edge is intense. This easily deteriorates the guillotine cutting edge. Thus, in case of a large number of cuts with the cutting unit and in case that "cut the air" with the cutting unit frequently occurs in one of the conveyance paths for two papers, the life of the cutting unit is shortened.

To equalize the positions of the rear ends of images printed on two papers, it is thinkable that the conveyance of one paper is stopped when an image has been printed on the paper, and printing an image and conveyance continue to the only other paper. In this case, however, the processing performance of the printer is lowered. Besides, it is also thinkable that two cutting units each including a cutting edge extending over only one paper are provided for cutting two papers disposed in parallel substantially at the same time with the respective cutting units. In this case, however, excessive manufacturing cost is produced. In addition, there is a disadvantage that a single wide paper having substantially the same width as the whole width of the paper conveyance path can not be cut.

In case of cutting two papers disposed in parallel at the rear ends of images substantially at the same time, the order of images printed on papers discharged from the printer may not be the same as the predetermined order of image data. As a result, the printed papers discharged from the printer must be rearranged in the order of image data.

SUMMARY OF THE INVENTION

An object of the present invention is to provide image recording apparatus capable of conveying or piling record media on which images have been recorded, in the order of images when images to be recorded on the record media being conveyed in parallel are in a predetermined sequence order.

Another object of the present invention is to provide image recording apparatus capable of decreasing the number of cuts of record media with a cutting unit when images including kinds of images different from each other in length are recorded in sequence on record media disposed in parallel with each other.

Still another object of the present invention is to provide image recording apparatus capable of suppressing the occurrence of "cut the air" with a cutting unit when images including kinds of images different from each other in length are recorded in sequence on record media disposed in parallel with each other.

Still another object of the present invention is to provide image recording apparatus capable of cutting record media on which images have been recorded, at suitable positions with preventing the processing performance from lowering when images including kinds of images different from each other in length are recorded in sequence on record media disposed in parallel with each other.

Still another object of the present invention is to provide image recording apparatus capable of discharging record media on which images have been recorded, in a predetermined sequence order when images including kinds of images different from each other in length to be recorded on record media disposed in parallel with each other are in the predetermined sequence order.

According to a first aspect of the present invention, an image recording apparatus comprises an image recording unit capable of recording images on record media neighboring each other. Each record medium has a long shape. The apparatus further comprises first conveyance means capable of conveying the record media independently of each other. The record media are disposed in parallel with each other. The apparatus further comprises a cutting unit disposed downstream of the image recording unit. The cutting unit is capable of cutting the record media being conveyed by the first conveyance means. The apparatus further comprises image allotment means for allotting images to each of the record media such that an order of images to be recorded on each record medium gradually increases toward a tail end of each record medium when images to be recorded on the record media are in a predetermined sequence order. The apparatus further comprises second conveyance means for conveying the record media cut by the cutting unit, in a direction crossing a conveyance direction by the first conveyance means. The apparatus further comprises conveyance control means for controlling the first conveyance means such that the order of images recorded on each record medium being conveyed by the second conveyance means and having reached a predetermined position increases one by one in the order of the record media having reached the predetermined position.

According to a second aspect of the present invention, an image recording apparatus comprises an image recording unit capable of recording images on record media neighboring each other. Each record medium has a long shape. The apparatus further comprises first conveyance means capable of conveying the record media independently of each other. The record media are disposed in parallel with each other. The apparatus further comprises a cutting unit disposed downstream of the image recording unit. The cutting unit is capable of cutting the record media being conveyed by the first conveyance means. The apparatus further comprises image allotment means for allotting images to each record medium such that an order of images to be recorded on each record medium gradually decreases toward a tail end of each record medium when images to be recorded on the record media are in a predetermined sequence order. The apparatus further comprises second conveyance means for conveying the record media cut by the cutting unit, in a direction crossing a conveyance direction by the first conveyance means. The apparatus further comprises conveyance control means for controlling the first conveyance means such that the order of images recorded on each record medium being conveyed by the second conveyance means and having reached a predetermined position decreases one by one in the order of the record media having reached the predetermined position.

According to a third aspect of the present invention, an image recording apparatus comprises an image recording unit capable of recording images on record media neighboring each other. Each record medium has a long shape. The apparatus further comprises conveyance means capable of conveying the record media independently of each other. The record media are disposed in parallel with each other. The apparatus further comprises a cutting unit disposed downstream of the image recording unit. The cutting unit includes a cutting edge extending over the record media. The apparatus further comprises conveyance control means for controlling the conveyance means such that rear ends of images recorded on the most front portion of at least two record media are aligned at a cutting position by the cutting unit and at this time, leading ends of the remaining record media are upstream of the cutting position when the image recording unit records images in sequence and the images include kinds of images different in length along lengths of the record media.

According to a fourth aspect of the present invention, an image recording apparatus comprises an image recording unit capable of recording images on record media neighboring each other. Each record medium has a long shape. The apparatus further comprises conveyance means capable of conveying the record media in parallel with each other. The conveyance means is further capable of forming a suspended portion of each record medium downstream of the image recording unit when the image recording unit records images in a sequence and the images include kinds of images different in length along lengths of the record media. The apparatus further comprises a cutting unit disposed downstream of suspended portions of the record media. The cutting unit includes a cutting edge extending over the record media being conveyed by the conveyance means. The apparatus further comprises detection means for detecting a quantity of the suspended portion of each record medium. The apparatus further comprises conveyance control means for controlling the conveyance means on the basis of detection results of the detection means such that each record medium has a suspended portion, one record medium is conveyed from its suspended portion toward the cutting unit, and the other record media are not conveyed from their suspended portions toward the cutting unit.

DESCRIPTION OF THE PREFERRED EMBODIMENTS

Preferred embodiments of the present invention will be described with reference to the accompanying drawings.

A first embodiment of the present invention will be described with reference to FIGS. 1 to 13.

Figure 1:
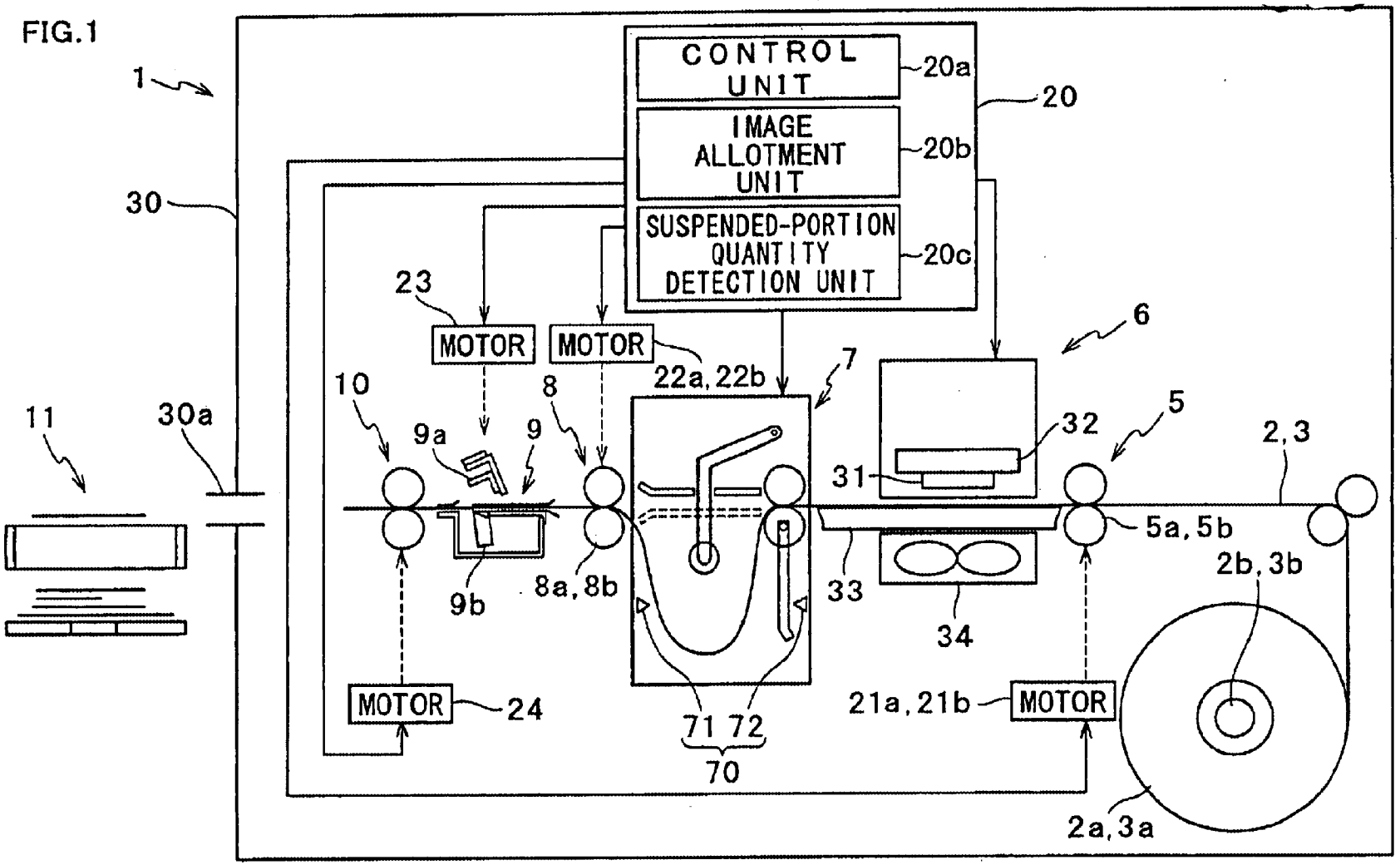
FIG. 1 is a schematic view illustrating the construction of an ink-jet printer according to a first embodiment of the present invention.

Referring to FIG. 1, an ink-jet printer 1 of this embodiment has a substantially rectangular parallelepiped casing 30, which includes therein a conveyance roller unit 5, an ink-jet printing unit 6, a suspended-portion formation unit 7, a pinching roller unit 8, a cutting unit 9, and a discharge roller unit 10. The printer 1 further includes a sorter unit 11 outside the casing 30. In the casing 30, long papers 2 and 3 formed into rolls 2*a* and 3*a* are so disposed as to horizontally neighbor each other. The rolls 2*a* and 3*a* of the papers 2 and 3 are supported on drums 2*b* and 3*b* rotatable around their axial centers. As will be described later, the operation of each part of the ink-jet printer 1 is controlled by a controller 20 disposed in the casing 30.

The conveyance roller unit 5 includes drive roller pairs 5*a* and 5*b* (see FIG. 2) driven by motors 21*a* and 21*b* controlled by the controller 20. The conveyance roller unit 5 cooperates with the pinching roller unit 8 to convey the papers 2 and 3 before being cut with the cutting unit 9. The conveyance roller unit 5 conveys downstream the papers 2 and 3 being taken out from the rolls 2*a* and 3*a*, makes the papers 2 and 3 pass through the ink-jet printing unit 6, and then feeds the papers 2 and 3 to the pinching roller unit 8. The drive roller pairs 5*a* and 5*b* are disposed in the conveyance path for the papers 2 and 3 so as to neighbor each other perpendicularly to the conveyance direction of the papers 2 and 3. Thus, when the papers 2 and 3 are conveyed in two lines, the drive roller pairs 5*a* and 5*b* can pinch the respective papers 2 and 3 to convey.

The ink-jet printing unit 6 includes a printing head 31, a carriage 32, a suction plate 33, and a suction fan 34. The printing head 31 is provided with a large number of ejection nozzles (not illustrated) for ejecting color inks such as yellow, magenta, cyan, and black. The printing head 31 can eject color inks through the many ejection nozzles onto a surface (the upper face in FIG. 1) of each paper 2 or 3 being conveyed, to print a predetermined color image. The printing head 31 may be provided with ejection nozzles for only black ink. In this case, a monochrome image is printed.

The ink-jet printing unit 6 ejects ink through nozzles dot by dot to print images on the papers 2 and 3. It can adopt any scheme, e.g., piezo- jet scheme, thermal-jet scheme, etc.

The carriage 32 supports the printing head 31. The carriage 32 is movable forward and backward perpendicularly to the conveyance direction of the papers 2 and 3. Thus, the printing head 31 is moved forward and backward with the carriage 32 perpendicularly to the conveyance direction of the papers 2 and 3 to eject ink toward the surface of each paper 2 or 3.

The suction plate 33 has a supporting face at the same level as the conveyance plane of the papers 2 and 3 to support the papers 2 and 3 opposite to the printing head 31. Thus, the printing head 31 is opposite to the face of the suction plate 33 and moved forward and backward along the width of the suction plate 33 to print images on the papers 2 and 3 on the suction plate 33. An area in the vicinity of the center of the suction plate 33 in the conveyance direction of the papers 2 and 3 is a printable area opposite to the printing head 31.

Figure 2:
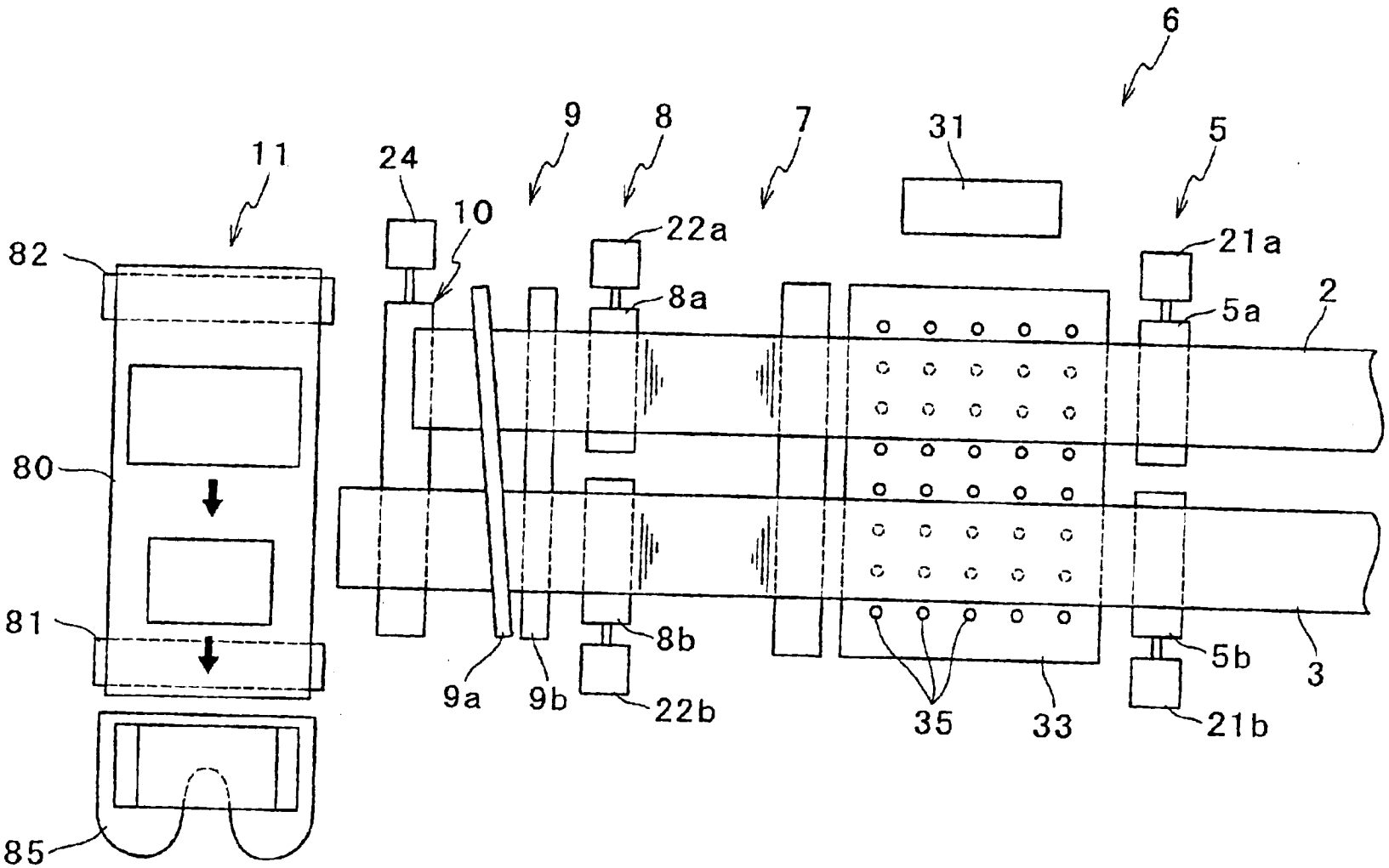
FIG. 2 is a plan view of the ink-jet printer of FIG. 1.

In the suction plate 33, as illustrated in FIG. 2, a large number of circular suction holes 35 are formed. The many suction holes 35 are formed substantially over the whole width of the suction plate 33. The suction holes 35 are arranged substantially evenly in the printable area on the suction plate 33 or in an area expanded upstream and downstream of the printable area in the conveyance direction of the papers 2 and 3.

The suction fan 34 is disposed on the opposite side of the conveyance path of the papers 2 and 3 to the printing head 31. The suction fan 34 sucks the papers 2 and 3 onto the suction plate 33 through the suction holes 35 formed in the suction plate 33. Thus, the papers 2 and 3 opposite to the printing head 31 are sucked by the suction fan 34 disposed under the back face (lower face in FIG. 1) to be conveyed in close contact with the suction plate 33. The distance of the papers 2 and 3 from the printing head 31 is thereby kept constant. Therefore, as will be described later, in case of the papers 2 and 3 curling, this printer can suppress occurrence of a trouble in printing due to a change in distance from the printing head 31 because parts of the papers 2 and 3 largely separate from the suction plate 33.

Figure 3:
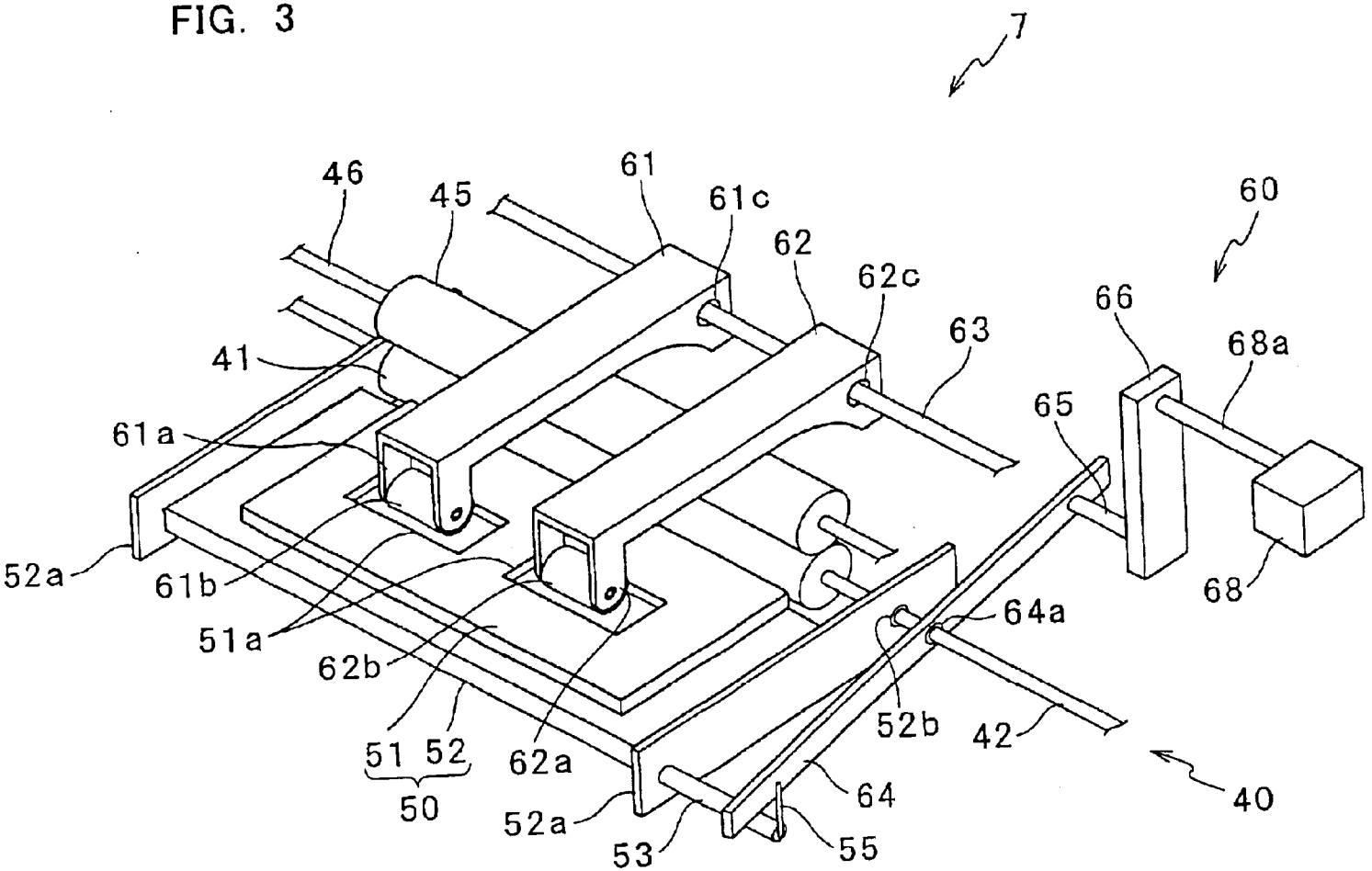
FIG. 3 is a perspective view of a suspended-portion formation unit included in the ink-jet printer of FIG. 1.

The suspended-portion formation unit 7 is disposed in between the ink-jet printing unit 6 and the pinching roller unit 8. Referring to FIG. 3, the suspended-portion formation unit 7 includes a roller unit 40, a guide unit 50, and an auxiliary unit 60. The suspended-portion formation unit 7 is provided with photosensors 70 (see FIG. 1) detectable whether the quantity of the suspended portion of each paper 2 or 3 has reached a predetermined amount.

The roller unit 40 includes a slave roller pair constituted by rollers 41 and 45 each having substantially the same width as that of the conveyance path of the papers 2 and 3, to pinch the papers 2 and 3 being conveyed between the ink-jet printing unit 6 and the pinching roller unit 8. The roller unit 40 is disposed on the most upstream position in the suspended-portion formation unit 7 in the conveyance direction of the papers 2 and 3. Shafts 42 and 46 are fitted in the centers of the respective rollers 41 and 45. Each shaft 42 or 46 is supported at its both ends by supporting members (not illustrated) so as to be rotatable.

The guide unit 50 is made up of an upper guide 51 and a lower guide 52. The guide unit 50 is disposed downstream of the roller unit 40. Either of the upper and lower guides 51 and 52 is made of a substantially rectangular board. The upper and lower guides 51 and 52 are disposed above and below the conveyance path of the papers 2 and 3 being conveyed between the ink-jet printing unit 6 and the pinching roller unit 8, to be opposite to each other. Thus, the papers 2 and 3 are conveyed between the lower face of the upper guide 51 and the upper face of the lower guide 52. In the upper guide 51, two rectangular openings 51*a* are formed symmetrically with respect to the center of the width of the upper guide 51.

The auxiliary unit 60 includes pressing members 61 and 62 disposed over the roller unit 40 and the guide unit 50, and a shaft 63 for supporting the pressing members 61 and 62. Through-holes 61*c* and 62*c* are formed near one ends of the respective pressing members 61 and 62. The shaft 63 is inserted in the through-holes 61*c* and 62*c*. Thus, either of the pressing members 61 and 62 is rotatable around the shaft 63. The shaft 63 is supported at its both ends by supporting members (not-illustrated).

In the other ends of the pressing members 61 and 62, supporting portions 61*a* and 62*a* each made up of a pair of board portions disposed in parallel with each other are formed so as to protrude downward. Rollers 61*b* and 62*b* are provided in the respective supporting portions 61*a* and 62*a*. The rollers 61*b* and 62*b* are supported through protrusions (not illustrated) formed on both axial end faces of the rollers 61*b* and 62*b* by the supporting portions 61*a* and 62*a* so as to be rotatable.

Either of the pressing members 61 and 62 is biased to rotate counterclockwise in FIG. 3 around the shaft 63 by its own weight (including the weight of the roller 61*b* or 62*b*). The rollers 61*b* and 62*b* of the pressing members 61 and 62 are disposed so as to correspond to the respective openings 51*a* of the upper guide 51.

As illustrated in FIG. 3, in a state wherein the lower guide 52 is disposed substantially horizontally, the rollers 61*b* and 62*b* of the pressing members 61 and 62 being biased downward in the openings 51*a* of the upper guide 51 press the upper face of the lower guide 52. Thus, when the papers 2 and 3 are being conveyed on the lower guide 52, the rollers 61*b* and 62*b* press the papers 2 and 3 onto the upper face of the lower guide 52 with rolling in the conveyance direction of the papers 2 and 3.

In a state wherein the lower guide 52 is disposed substantially vertically as will be described later, the rollers 61*b* and 62*b* of the pressing members 61 and 62 move downward more than the positions in the state wherein the lower guide 52 is disposed substantially horizontally as illustrated in FIG. 3. The rollers 61*b* and 62*b* pass through the openings 51*a* of the upper guide 51 and they are positioned below the conveyance plane of the papers 2 and 3 (see FIG. 1). The rollers 61*b* and 62*b* of the pressing members 61 and 62 move below the conveyance plane because the lower guide 52 has moved and it can not stop the movements of the rollers 61*b* and 62*b* of the pressing members 61 and 62 by their own weights.

The auxiliary unit 60 includes a board 64 disposed so as to neighbor the outside of one end of the lower guide in its width (end on the side where the paper 3 is conveyed). The board 64 is for switching over the state of the lower guide 52 between a substantially horizontal posture and a substantially vertical posture. An opening 64*a* is formed substantially at the center of the board 64. The shaft 42 of the roller unit 40 is inserted in the opening 64*a*. Thus, the board 64 is rotatable around the shaft 42.

The board 64 is connected in the vicinity of its one end with one end of a substantially rectangular parallelepiped cam 66 through an interconnecting member 65. The board 64 is coupled with the interconnecting member 65 so as to be rotatable relatively to the interconnecting member 65. Also, the cam 66 is coupled with the interconnecting member 65 so as to be rotatable relatively to the interconnecting member 65. An output axis 68*a* of an electric motor 68 is connected to the face of the cam 66 opposite to the face to which the interconnecting member 65 is connected. Thus, when the controller 20 drives the motor 68, the cam 66 rotates around the output axis 68*a*. As the cam 66 rotates, the interconnecting member 65 also rotates around the output axis 68*a*. As a result, the board 64 rotates around the shaft 42. The cam 66 can move between a state wherein it is disposed substantially vertically as illustrated in FIG. 3 (a state wherein the horizontal level of the interconnecting member 65 is substantially the same as the horizontal level of the shaft 42) and a state wherein it has been rotated clockwise in FIG. 3 by 90 degrees from the above state around the output axis 68*a* and it is disposed substantially horizontally (a state wherein the interconnecting member 65 is disposed substantially just above the shaft 42).

Side walls 52*a* are provided at both ends of the lower guide 52 in its width. The length of each side wall 52*a* in the conveyance direction of the papers 2 and 3 is more than the length of the lower guide 52 in the conveyance direction of the papers 2 and 3. Therefore, although the ends of the side walls 52*a* and the end of the lower guide 52 facing the downstream direction of the paper flow are substantially at the same position, the ends of the side walls 52*a* facing the upstream direction of the paper flow protrude beyond the end of the lower guide 52 facing the upstream direction of the paper flow.

Openings 52*b* are formed near the ends of the side walls 52*a* facing the upstream direction of the paper flow. The shaft 42 is inserted through the openings 52*b* of the side walls 52*a*. Thus, each side wall 52*a*, that is, the lower guide 52, is rotatable around the shaft 42.

In the vicinity of the end, facing the downstream direction of the paper flow, of the side wall 52*a* facing the board 64 of the lower guide 52, a protrusion 53 is formed to protrude outward beyond the conveyance path in its width. The upper end of the protrusion 53 in the vicinity of the distal end of the protrusion 53 is in contact with the lower face of the front end portion of the board 64 (the end opposite to the end to which the cam 66 is coupled). A vicinity of the front end of the board 64 is connected through a connecting member 55 with the distal end of the protrusion 53 of the side wall 52*a* facing the board 64 of the lower guide 52. The connecting member 55 may be an elastic member, such as a coil spring, having elasticity, or a bar having no elasticity.

In a state wherein the lower guide 52 is disposed substantially horizontally as illustrated in FIG. 3, when the cam 66 disposed substantially vertically is rotated clockwise in FIG. 3 by 90 degrees around the output axis 68*a*, the cam 66 moves to be disposed substantially horizontally. At this time, through the interconnecting member 65 moved with the cam 66, the board 64 is rotated counterclockwise around the shaft 42 so that the front end portion of the board 64 moves just below the shaft 42. When the board 64 is rotated, the front end portion of the board 64 in contact with the protrusion 53 of the lower guide 52 pushes down the protrusion 53, so that the lower guide 52 is also rotated counterclockwise around the shaft 42. As a result, the lower guide 52 is disposed substantially vertically (see FIG. 1).

In a state wherein the lower guide 52 is disposed substantially vertically as described above, when the cam 66 disposed substantially horizontally is rotated counterclockwise in FIG. 3 by 90 degrees around the output axis 68*a*, the cam 66 moves to be disposed substantially vertically (returns to the original state as illustrated in FIG. 3). At this time, through the interconnecting member 65 moved with the cam 66, the board 64 is rotated clockwise around the shaft 42 so that the front end portion of the board 64 moves to the same horizontal level as that of the shaft 42. When the board 64 is rotated, the front end portion of the board 64 pulls up the protrusion 53 of the lower guide 52 through the connecting member 55, so that the lower guide 52 is also rotated clockwise around the shaft 42. As a result, the lower guide 52 returns to the original state as illustrated in FIG. 3, wherein it is disposed substantially horizontally.

As will be described later, in a state wherein the lower guide 52 is disposed substantially vertically, when the papers 2 and 3 are conveyed by the conveyance roller unit 5 and held by the pinching roller unit 8 so that they are not conveyed downstream of the pinching roller unit 8, a suspended portion suspended downward beyond the conveyance plane of the papers 2 and 3 is formed in each of the papers 2 and 3. The suspended portion of each of the papers 2 and 3 means the portion of each of the papers 2 and 3 between the position pinched by the roller unit 40 of the suspended-portion formation unit 7 and the position pinched by the pinching roller unit 8. Between the ink-jet printing unit 6 and the pinching roller unit 8, that is, under the suspended-portion formation unit 7, a space is provided for receiving therein suspended portions of the papers 2 and 3.

In the suspended-portion formation unit 7, the photosensors 70 detectable whether the quantity of the suspended portion of each paper 2 or 3 has reached a predetermined amount are provided at a level a predetermined distance lower than the conveyance plane of the papers 2 and 3. The photosensors 70 are disposed so as to correspond to the respective papers 2 and 3 to be conveyed in two lines. Each photosensor 70 includes a pair of elements, i.e., a light-emitting element 71 such as an LED and a light-receiving element 72 disposed at a position to be able to receive a light emitted from the light-emitting element 71. The photosensors 70 are connected with the controller 20.

In each photosensor 70, when the light-receiving element 72 can receive a light emitted from the light-emitting element 71, it is detected that there is not a paper 2 or 3 between the elements. Contrastingly, when the light-receiving element 72 can not receive a light emitted from the, light-emitting element 71, it is detected that there is a paper 2 or 3 between the elements. Thus, by detecting output signals of the photosensors 70 corresponding to the respective papers 2 and 3, the controller 20 can know whether or not a suspended portion of each of the papers 2 and 3 exists at the sensor position corresponding to the horizontal level where the photosensors 70 are provided. That is, by predetermining the vertical distance between the conveyance plane of the papers 2 and 3 and the horizontal plane where the photosensors 70 are provided, it can be detected whether the quantity of the suspended portion of each of the papers 2 and 3 has reached a predetermined value or the quantity is less than the predetermined value. In this embodiment, in order that the lower guide 52 should not interrupt the light path between the light-emitting element 71 and the light-receiving element 72 of each photosensor 70 even when the lower guide 52 is disposed substantially vertically, openings (not illustrated) are formed in the lower guide 52 to correspond to the respective photosensors 70.

The pinching roller unit 8 includes drive roller pairs 8*a* and 8*b* to be driven by electric motors 22*a* and 22*b* under the control of the controller 20. The pinching roller unit 8 pinches the papers 2 and 3 being conveyed between the suspended-portion formation unit 7 and the cutting unit 9. As illustrated in FIG. 2, the drive roller pairs 8*a* and 8*b* of the pinching roller unit 8 are disposed in the conveyance path of the papers 2 and 3 to neighbor each other perpendicularly to the conveyance direction of the papers 2 and 3, like the drive roller pairs 5*a* and 5*b* of the conveyance roller unit 5.

The pinching roller unit 8 can be in a state wherein it conveys, downstream of it, each of the papers 2 and 3 being conveyed by the conveyance roller unit 5, and a state wherein it does not convey, downstream of it, each of the papers 2 and 3 being conveyed by the conveyance roller unit 5. In a state wherein the pinching roller unit 8 does not convey each of the papers 2 and 3 downstream of the pinching roller unit 8, each of the papers 2 and 3 is held by the corresponding drive roller pair 8*a* or 8*b* of the pinching roller unit 8 not to move. Thus, when each of the papers 2 and 3 being conveyed by the conveyance roller unit 5 is not conveyed by the pinching roller unit 8, a suspended portion of each of the papers 2 and 3 is formed in the suspended-portion formation unit 7 disposed upstream of the pinching roller unit 8 in the conveyance direction of the papers 2 and 3.

As described above, in the suspended-portion formation unit 7 of this embodiment, a tensionless suspended portion is formed in any of the papers 2 and 3. In a modification, however, movable rollers may form tensioned suspended portions in the papers 2 and 3.

The conveyance rate of each of the papers 2 and 3 by the pinching roller unit 8 is controlled by the controller 20 independently of the conveyance rate of each of the papers 2 and 3 by the conveyance roller unit 5. Therefore, the pinching roller unit 8 can convey the papers 2 and 3 downstream of the pinching roller unit 8 irrespective of the conveyance state of the papers 2 and 3 by the conveyance roller unit 5.

The cutting unit 9 includes a moving cutting edge 9*a* disposed on the same side of the papers 2 and 3 as the printing head 31, and a fixed cutting edge 9*b* disposed on the opposite side of the papers 2 and 3 to the moving cutting edge 9*a*. Each of the moving and fixed cutting edges 9*a* and 9*b* has a rectangular shape having a length extending over the papers 2 and 3 disposed in two lines. By an electric motor 23 under the control of the controller 20, the moving cutting edge 9*a* can get close to or apart from the fixed cutting edge 9*b*. The moving cutting edge 9*a* cooperates with the fixed cutting edge 9*b* to cut the printed papers 2 and 3 being conveyed from the upstream direction along the widths of the papers 2 and 3. By thus being cut, the printed papers 2 and 3 are separated into predetermined lengths. The cutting unit 9 can cut the papers 2 and 3 being conveyed in two lines in the conveyance path, substantially at the same time.

The discharge roller unit 10 includes a drive roller pair to be driven by an electric motor 24 under the control of the controller 20. The discharge roller unit 10 conveys the printed papers 2 and 3 cut by the cutting unit 9, and discharges them through a discharge port 30*a*. The drive roller pair of the discharge roller unit 10 has a width substantially equal to the width of the conveyance path of the papers 2 and 3.

As illustrated in FIG. 2, the sorter unit 11 provided near the discharge port 30*a* outside the casing 30 includes a conveyor belt 80 wound on a drive roller 81 and a slave roller 82, and a tray 85. The tray 85 is disposed on the opposite side of the conveyance path of the paper 3 to the paper 2. On the tray 85, printed papers 2 and 3 are piled. The conveyor belt 80 conveys papers 2 and 3 cut into predetermined lengths and discharged through the discharge port 30*a* of the casing 30, substantially in the same horizontal plane as the conveyance plane within the casing 30, in a direction crossing the conveyance direction within the casing 30, to feed the papers 2 and 3 onto the tray 85. By the drive roller 81 driven by an electric motor (not illustrated) under the control of the controller 20, printed papers 2 and 3 are conveyed by the conveyor belt 80 in the order of being discharged through the discharge port 30*a*, and piled on the tray 85, thereby a printing operation is completed.

The controller 20 includes a control unit 20*a*, an image allotment unit 20*b*, and a suspended-portion quantity detection unit 20*c*. The control unit 20*a* controls the conveyance rates and the conveyance timings of the papers 2 and 3 by the conveyance roller unit 5, the pinching roller unit 8, and the discharge roller unit 9, the movement timings of the lower guide 52 in the suspended-portion formation unit 7, the cut timings of the papers 2 and 3 by the cutting unit 9, etc.

The control unit 20*a* applies a predetermined process to an image signal supplied through a not-illustrated input interface, and then supplies, to the ink-jet printing unit 6, a print signal including image data corresponding to images to be printed. At this time, the movement timings of the carriage 32 in the ink-jet printing unit 6, the ejection timings of ink from the printing head 31, etc., are controlled. Printing of images by the ink-jet printing unit 6 is performed in accordance with allotment of the images by the image allotment unit 20*b*.

The image allotment unit 20*b* determines which of the papers 2 and 3 each image included in image data supplied to the ink-jet printing unit 6 should be printed on. Thus, as will be described later, images are printed with being allotted by the image allotment unit 20*b* to each of the papers 2 and 3 in the order of photographing. In this embodiment, images arranged in the order of photographing are allotted to each of the papers 2 and 3 such that the order of an image to be printed in a predetermined order from the leading end of the paper 3 closer to the tray 85 is smaller by one than that of the paper 2. Further, the images are allotted such that the order of images to be printed on each of the papers 2 and 3 gradually increases by 2, which is the number of papers being conveyed in parallel from the leading end toward the tail end of each of the papers 2 and 3. Consequently, images of odd numbers 1, 3, 5, 7, . . . , are allotted to the paper 3 and images of even numbers 2, 4, 6, 8, . . . , are allotted to the paper 2 (see FIG. 5). Allotment of images by the image allotment unit 20*b* in this embodiment will be described later in detail.

The suspended-portion quantity detection unit 20*c* is for detecting the quantity of a suspended portion of each of the papers 2 and 3 in the suspended-portion formation unit 7. On the basis of the conveyance quantity of each of the papers 2 and 3 by the conveyance roller unit 5 and the conveyance quantity of each of the papers 2 and 3 by the pinching roller unit 8, the suspended-portion quantity detection unit 20*c* can detect the quantity of the suspended portion of each of the papers 2 and 3 at that time. The suspended-portion quantity detection unit 20*c* can detect the quantity of the suspended portion of each of the papers 2 and 3 when the conveyance quantities of each of the papers 2 and 3 by the conveyance roller unit 5 and the pinching roller unit 8 are optionally changed, without actually changing the conveyance quantities. Further, the suspended-portion quantity detection unit 20*c* can compare the quantity of the suspended portion of each of the papers 2 and 3 detected as described above with a predetermined value. The predetermined value to be used for the comparison in the suspended-portion quantity detection unit 20*c* corresponds to the quantity of the suspended portion when each paper has reached the sensor position corresponding to each photosensor 70.

Next, an operation of the ink-jet printer 1 constructed as described above according to this embodiment will be described with reference to FIGS. 4 to 13.

First, when the motors 21*a* and 21*b* drive the respective drive roller pairs 5*a* and 5*b* of the conveyance roller unit 5, the papers 2 and 3 being pinched by the respective drive roller pairs 5*a* and 5*b* are taken out from the rolls 2*a* and 3*a*. The papers 2 and 3 are conveyed from their respective leading ends onto the suction plate 33 in order.

Subsequently, when the papers 2 and 3 are conveyed downstream substantially at the same speed with being sucked to the suction holes 35, a region in the vicinity of the leading end of each of the papers 2 and 3 reaches the printable area opposite to the printing head 31. At this time, either of the papers 2 and 3 on the suction plate 33 is sucked onto the suction plate 33 through the suction holes 35 by the suction fan 34.

Printing of images is performed onto each of the papers 2 and 3 with conveying the papers 2 and 3 and alternately repeating forward and backward movements of the printing head 31 perpendicular to the conveyance direction of the papers 2 and 3. At this time, the printing head 31 is moved forward and backward in a range wider than the interval between the outer ends of the papers 2 and 3 in their widths. Printing of images may be performed upon the only forward movement of the printing head 31 or upon both the forward and backward movements of the printing head 31.

Figure 4:
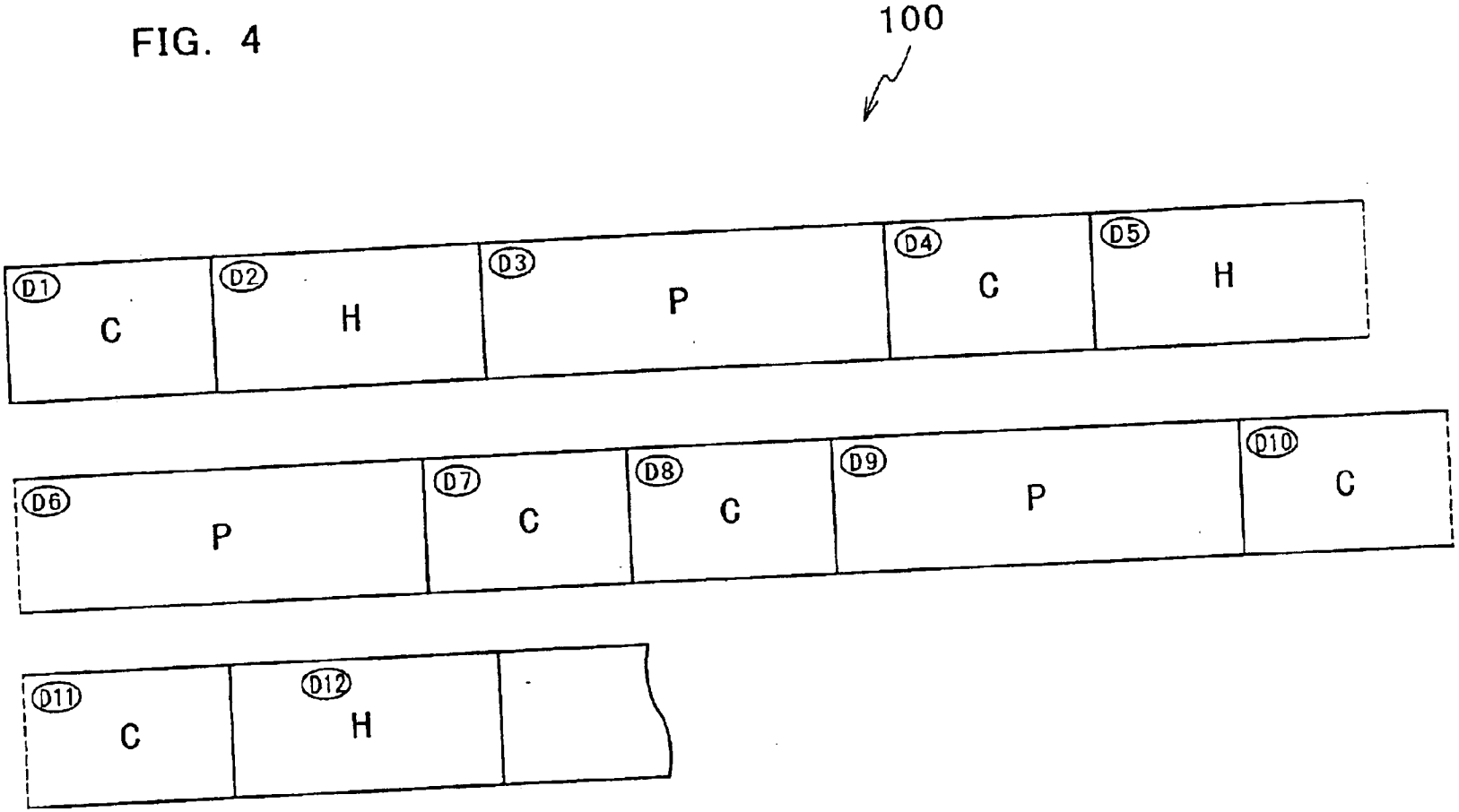
FIG. 4 is a schematic plan view of a film recorded thereon image data according to the first embodiment.

Image data in this embodiment is based on image data recorded on one film 100 as illustrated in FIG. 4. FIG. 4 schematically illustrates the photographing order and the print types of images recorded on the film 100. FIG. 4 illustrates only top twelve of images recorded on the film 100. In this embodiment, a printing operation of these twelve images will be described. In FIG. 4, references D1, D2, D3, . . . , indicate the photographing order, and they may be used for indicating the respective images.

On the film 100, images to be printed in different print types are recorded together. Print type means the size of each image to be printed and it is defined in general by the aspect ratio of print image. The ink-jet printer 1 of this embodiment can print images of print types of classic type (hereinafter referred to as "C type"), Hi-vision type (hereinafter referred to as "H type"), and panorama type (hereinafter referred to as "P type") for example The aspect ratio of image of each print type is set at 2:3 in C type, 9:16 in H type, and 1:3 in P type for example. Therefore, comparing the lengths of images of the print types when printed on the papers 2 and 3 having the same width, the image length increases in the order of "C type", "H type", and "P type".

As illustrated in FIG. 4, on the film 100 of this embodiment, from its leading end, images are recorded in sequence to be printed in print types of "D1: C type", "D2: H type", "D3: P type", "D4: C type", "D5: H type", "D6: P type", "D7: C type", "D8: C type", "D9: P type", "D10: C type", "D11: C type", and "D12: H type". Each of the images D1 to D12 is printed in order with being allotted to each of the papers 2 and 3 in the order of photographing.

Allotment of images by the image allotment unit 20*b* will be described in detail with reference to FIG. 5.

As described above, the image allotment unit 20*b* allots each of the images D1 to D12 recorded on the film 100 in the photographing order such that the order of an image to be recorded in a predetermined order from the leading end of the paper 3 closer to the tray 85 is one lower than that of the paper 2. Further, the images are allotted such that the order of image to be recorded on each of the papers 2 and 3 gradually increases by twos toward the tail end of the paper. That is, the images D1 to D12 are allotted in the photographing order irrespective of their print types.

Upon the start of printing, the top image "D1: C type" is allotted to the paper 3 closer to the tray 85. That is, the image "D1: C type" is printed in a region near the leading end of the paper 3. The next image "D2: H type" is allotted to the paper 2. That is, the image "D2: H type" is printed in a region near the leading end of the paper 2.

Subsequently, the image "D3: P type" is allotted to the paper 3 and then the image "D4: C type" is allotted to the paper 2. That is, the image "D3: P type" is printed on the rear side of the region of the paper 3 where "D1: C type" has been printed, and the image "D4: C type" is printed on the rear side of the region of the paper 2 where "D2: H type" has been printed.

Subsequently, like the above, the images D5 to D12 are alternately allotted to the papers 2 and 3. As a result, as illustrated in FIG. 5, on the paper 2, from its leading end, the images "D2: H type", "D4: C type", "D6: P type", "D8: C type", "D10: C type", and "D12: H type" are allotted in this order. On the other hand, on the paper 3, from its leading end, the images "D1: C type", "D3: P type", "D5: H type", "D7: C type", "D9: P type", and "D11: C type" are allotted in this order.

Hereinafter, an operation after regions near the leading ends of the papers 2 and 3 have reached the printable region and printing images on the papers 2 and 3 is started, will be described with reference to FIGS. 6 to 13 each illustrating a state of a suspended portion of each of the papers 2 and 3.

Figure 5:
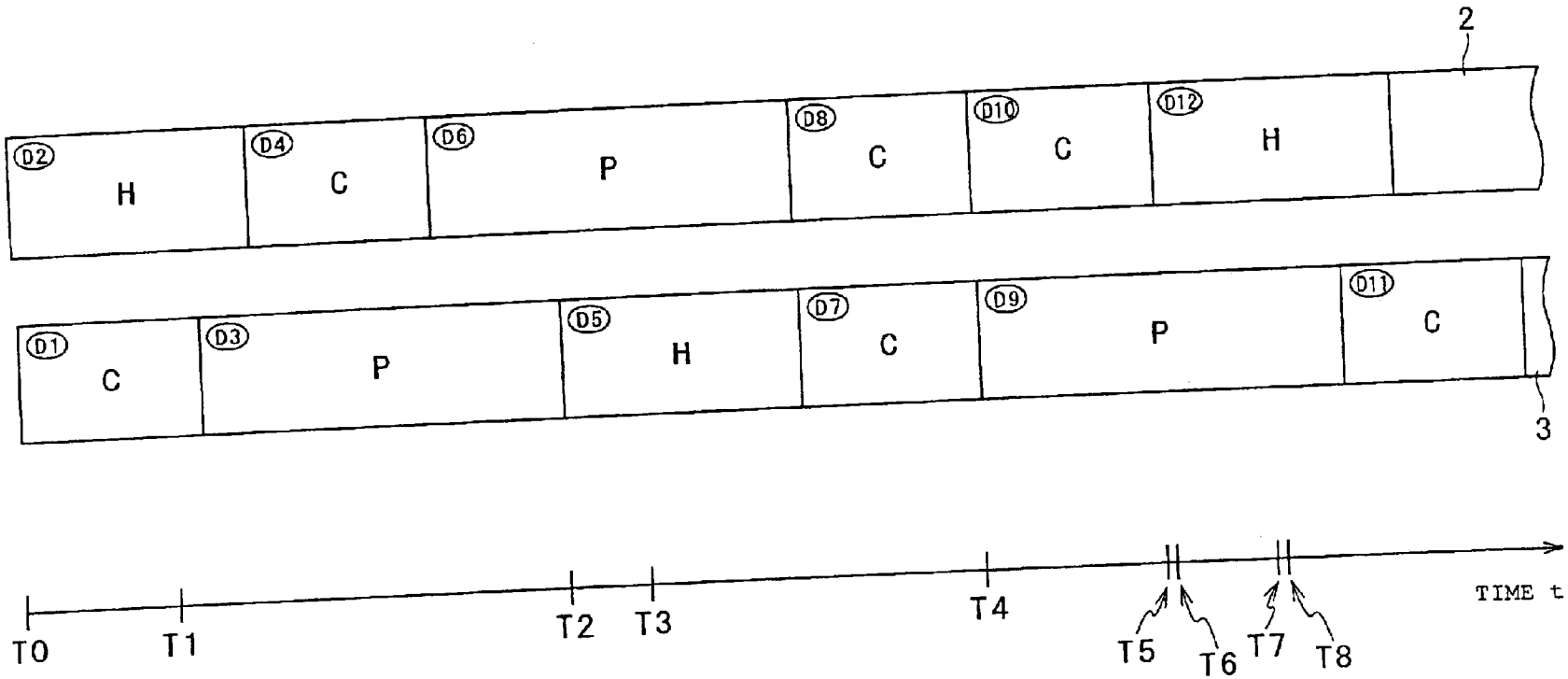
FIG. 5 is a schematic view for explaining allotment of images to two papers according to the first embodiment.

A time axis in FIG. 5 shows the time elapse from the start of printing. Positions on the time axis correspond to the positions of the respective images D1 to D12 allotted to the papers 2 and 3. That is, at time T0 (the start of printing), printing the image D2 is started from the leading end of the paper 2 and printing the image D1 is started from the leading end of the paper 3. Further, at time T4 for example, printing the images D2, D4, D6, and D8 has been completed on the paper 2 and printing the images D1, D3, D5, and D7 has been completed on the paper 3.

FIGS. 6 to 13 illustrate a state of a suspended portion of each of the papers 2 and 3 at each of times T1 to T8 in FIG. 5. In FIGS. 6 to 13, the position of an end of the printable region in the ink-jet printing unit 6 on the downstream direction of the paper flow is indicated as "printing position", a position where the papers 2 and 3 are to be cut by the cutting unit 9 is indicated as "cutting position" (the above two are shown with broken lines), and a position corresponding to the photosensors 70 is indicated as "sensor position" (this is shown with an alternate long and two dashes line).

Figure 6:
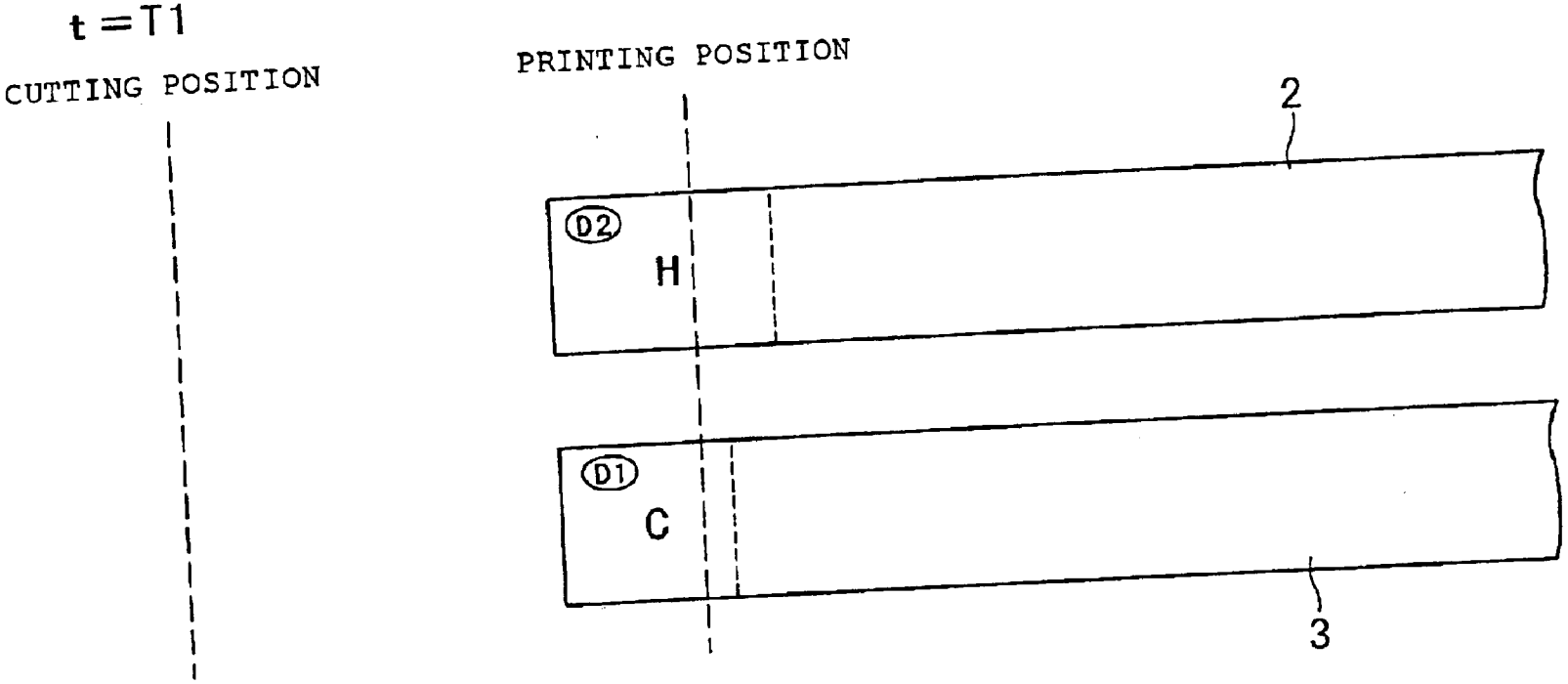
FIG. 6 is a schematic view illustrating a state of each paper in the vicinity of a suspended portion according to the first embodiment.

When regions near the leading ends of the papers 2 and 3 reach the printable region, printing on the papers 2 and 3 is started (a state at time T0 in FIG. 5). While the papers 2 and 3 are conveyed substantially at the same speed, as illustrated in FIG. 6, printing the image "D1: C type" on a region near the leading end of the paper 3 and printing the image "D2: H type" on a region near the leading end of the paper 2 are performed substantially at the same time (a state at time T1 in FIG. 5).

Figure 7:
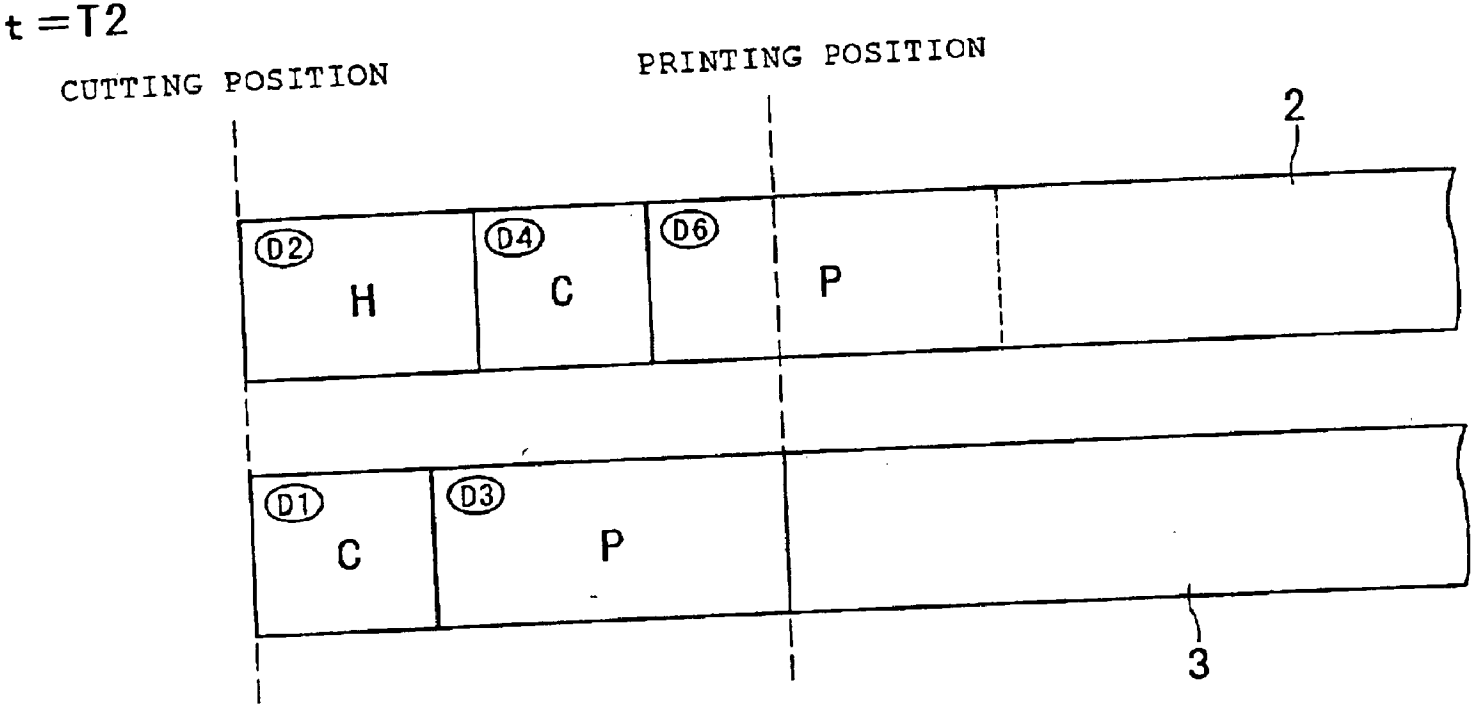
FIG. 7 is a schematic view illustrating a state of each paper in the vicinity of a suspended portion according to the first embodiment.

After this, when printing on the papers 2 and 3 is continued and printing the images "D1: C type" and "D3: P type" has been completed, the leading end of the paper 3 reaches the cutting position in the cutting unit 9 as illustrated in FIG. 7 (a state at time T2 in FIG. 5). At this time, on the paper 2, printing the images "D2: H type" and "D4: C type" was completed and printing the image "D6: P type" is halfway. Like the paper 3, also the leading end of the paper 2 has reached the cutting position in the cutting unit 9.

In the printing operation from the state at time T0 upon the start of printing to the state at time T2, the papers 2 and 3 are conveyed downstream by the conveyance roller unit 5. After printing is completed, the papers 2 and 3 being conveyed between the ink-jet printing unit 6 and the pinching roller unit 8 are being conveyed between the upper and lower guides 51 and 52 of the guide unit 50 of the suspended-portion formation unit 7. At this time, the papers 2 and 3 are pinched by the rollers 41 and 45 of the roller unit 40 and pressed onto the lower guide 52 by the rollers 61*b* and 62*b* of the pressing members 61 and 62 of the auxiliary unit 60 that have enter downward the openings 51*a* of the upper guide 51.

At this time, either of the drive roller pairs 8*a* and 8*b* of the pinching roller unit 8 is driven to rotate in the conveyance direction of the papers 2 and 3. Thus, when the leading ends of the papers 2 and 3 reach the drive roller pairs 8*a* and 8*b*, the papers 2 and 3 are pinched by the drive roller pairs 8*a* and 8*b* and conveyed downstream. After this, when either of the leading ends of the papers 2 and 3 reaches the cutting position in the cutting unit 9, the controller 20 stops to drive the drive roller pairs 8*a* and 8*b* of the pinching roller unit 8. Thus, the regions near the leading ends of the papers 2 and 3 are held by the pinching roller unit 8 not to be conveyed downstream of the pinching roller unit 8.

At time T2 when either of the leading ends of the papers 2 and 3 reaches the cutting position in the cutting unit 9, when the controller 20 drives the motor 68 of the suspended-portion formation unit 7, the board 64 is rotated to move the lower guide 52 into a substantially vertical posture, as described above. When the lower guide 52 is thus moved into a substantially vertical posture, the movements in the biased direction of the rollers 61*b* and 62*b* of the pressing members 61 and 62 are not stopped by the lower guide 52. Hence, the pressing members 61 and 62 rotate around the shaft 63. Therefore, the rollers 61*b* and 62*b* of the pressing members 61 and 62 that have pressed the papers 2 and 3 onto the lower guide 52 push the papers 2 and 3 downward of the conveyance plane of the papers 2 and 3.

In this embodiment, at the timing when either of the leading ends of the papers 2 and 3 has reached the cutting position in the cutting unit 9, the pinching roller unit 8 is stopped to be driven and the lower guide 52 is moved into a substantially vertical posture. But, in a modification, at the timing when the leading ends of the papers 2 and 3 has reached the pinching roller unit 8 and they are pinched by the pinching roller unit 8, the pinching roller unit 8 may be stopped to be driven and the lower guide 52 may be moved into a substantially vertical posture. That is, even when the papers 2 and 3 are pushed by the pressing members 61 and 62 downward of the conveyance plane of the papers 2 and 3 and the leading ends of the papers 2 and 3 are pulled upstream in the conveyance direction of the papers 2 and 3, it is preferable that the lower guide 52 is moved into a substantially vertical posture after the leading ends of the papers 2 and 3 are held so as to hardly change their positions.

Figure 8:
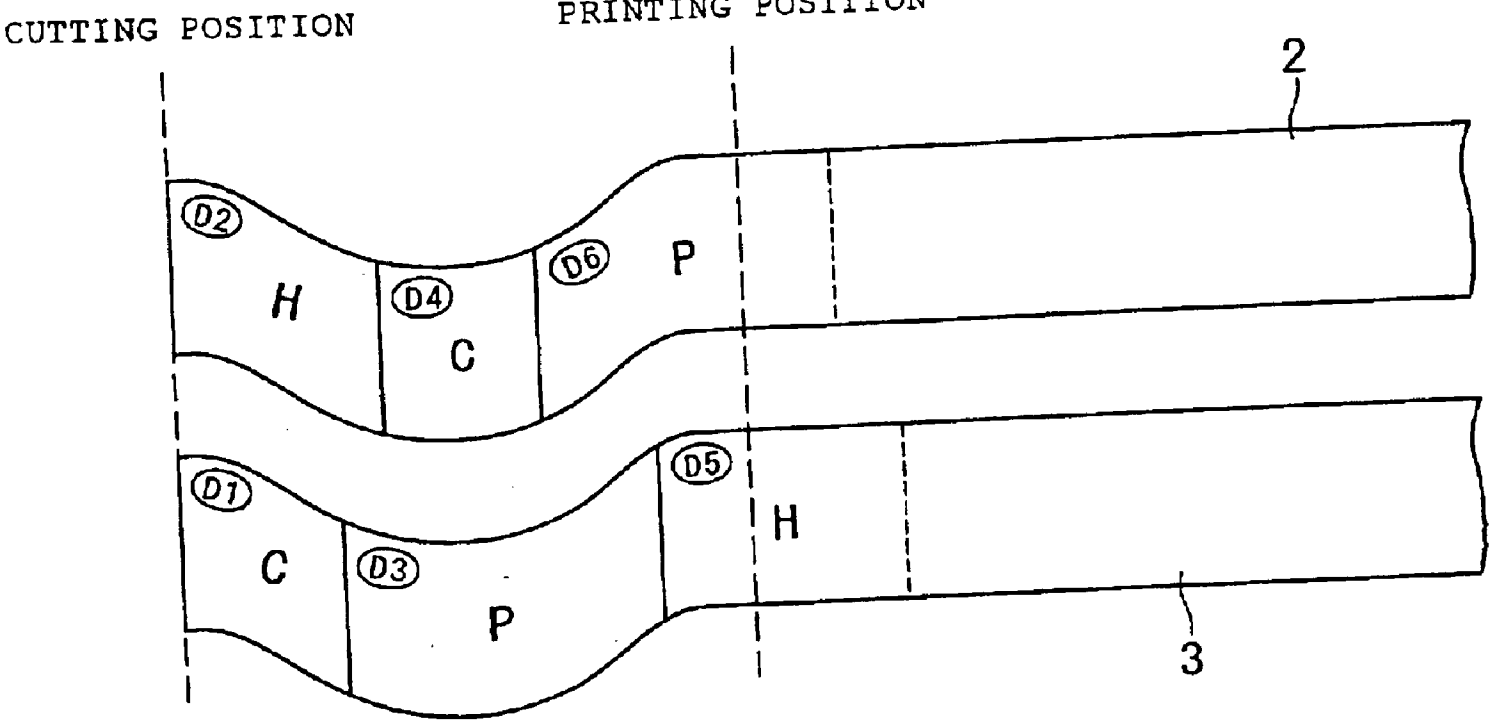
FIG. 8 is a schematic view illustrating a state of each paper in the vicinity of a suspended portion according to the first embodiment.

In a state that the papers 2 and 3 are held by the pinching roller unit 8 so as not to be conveyed downstream of the pinching roller unit 8 and the papers 2 and 3 are pushed downward of the conveyance plane by the pressing members 61 and 62 of the suspended-portion formation unit 7, when conveyance by the conveyance roller unit 5 and printing are continued, each of the papers 2 and 3 forms a suspended portion in the suspended-portion formation unit 7 as illustrated in FIG. 8 (a state at time T3 in FIG. 5).

Figure 9:
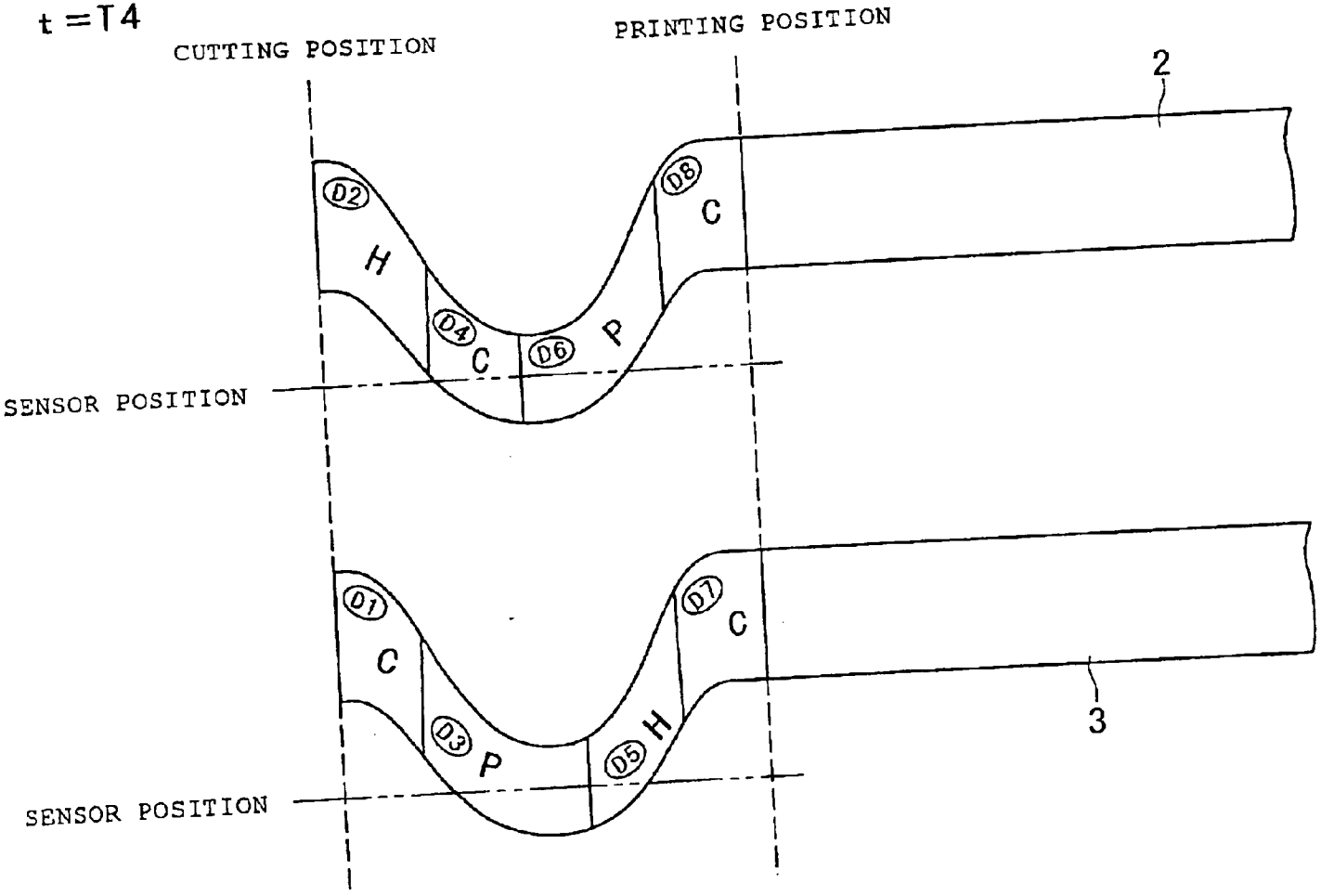
FIG. 9 is a schematic view illustrating a state of each paper in the vicinity of a suspended portion according to the first embodiment.

After this, when printing on the papers 2 and 3 is further continued and printing the fourth image "D7: C type" on the paper 3 is completed, the lower end of the suspended portion of the paper 3 reaches the sensor position corresponding to the photosensors 70 as illustrated in FIG. 9 (a state at time T4 in FIG. 5). At this time, on the paper 2, printing the fourth image "D8: C type" has been completed. Like the paper 3, also the lower end of the suspended portion of the paper 2 has reached the sensor position corresponding to the photosensors 70. That is, the quantities of the suspended portions of the papers 2 and 3 at this time are substantially the same.

Figure 10:
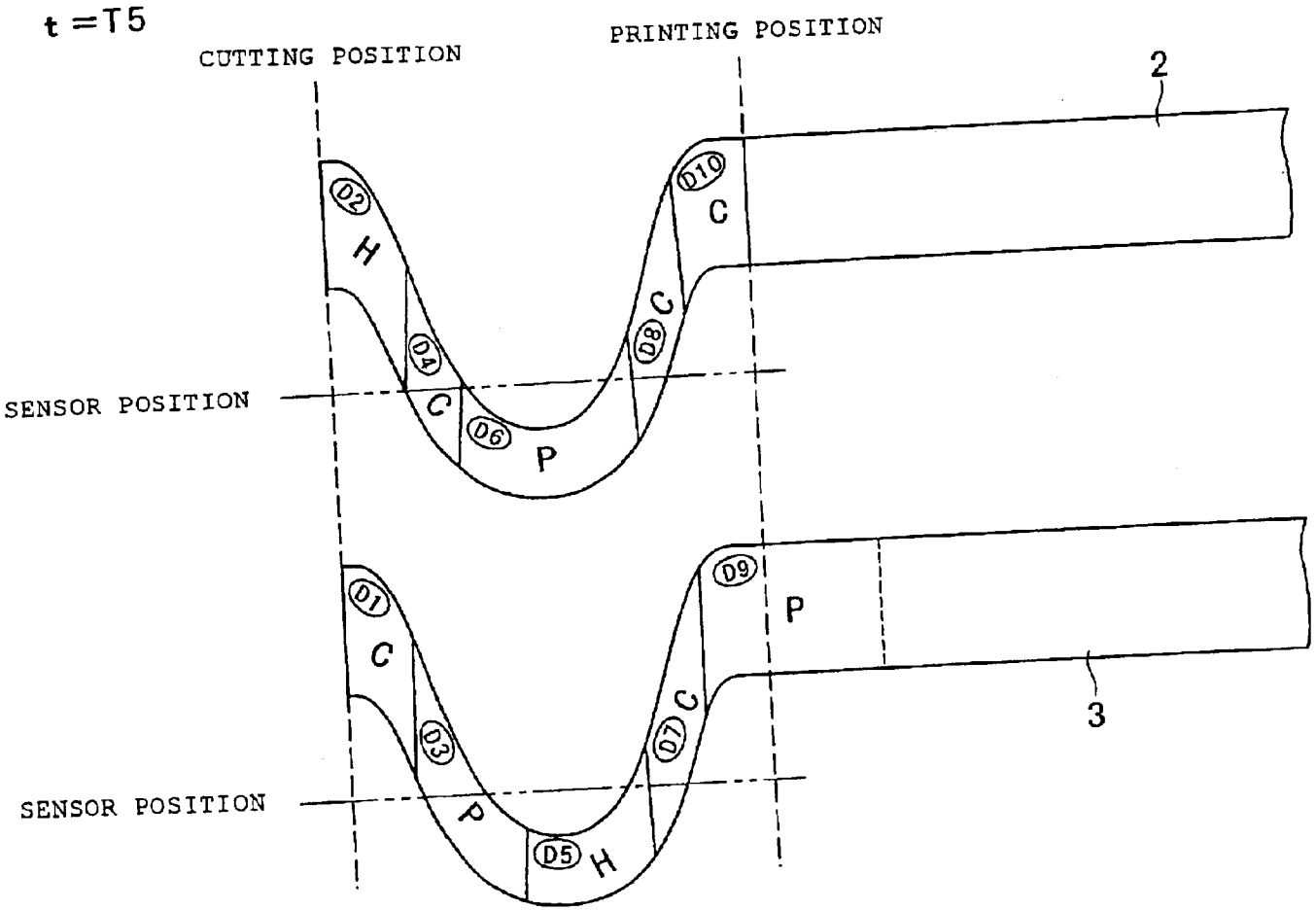
FIG. 10 is a schematic view illustrating a state of each paper in the vicinity of a suspended portion according to the first embodiment.

When printing on the papers 2 and 3 is further continued, the quantities of the suspended portions of the papers 2 and 3 increase gradually. When printing an image in a region having the same length as the image "D1: C type" from the front end of the fifth image "D9: P type" on the paper 3 is completed, the lower end of the suspended portion of the paper 3 reaches a position lower than the sensor position corresponding to the photosensors 70 as illustrated in FIG. 10 (a state at time T5 in FIG. 5). At this time, on the paper 2, printing the fifth image "D10: C type" is halfway. Like the paper 3, also the lower end of the suspended portion of the paper 2 has reached a position lower than the sensor position corresponding to the photosensors 70.

Figure 11:
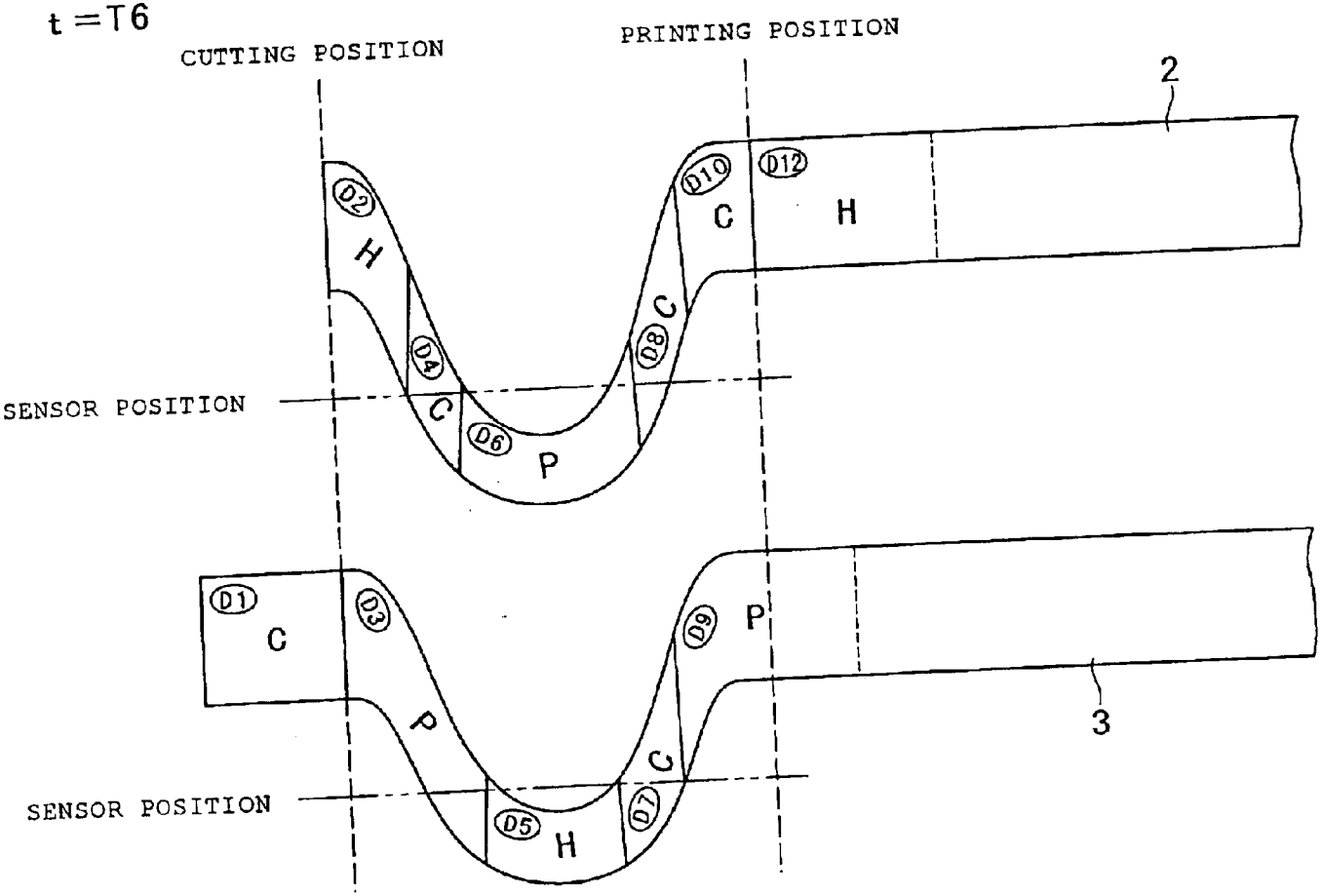
FIG. 11 is a schematic view illustrating a state of each paper in the vicinity of a suspended portion according to the first embodiment.

Immediately after the lower end of the suspended portion of the paper 3 reaches a position lower than the sensor position corresponding to the photosensors 70 and the quantity of the suspended portion of the paper 3 has sufficiently increased, the pinching roller unit 8 is switched over from a state of holding both the papers 2 and 3 into a state of conveying the only paper 2 downstream (a state at time T6 in FIG. 5). As a result, the leading end of the only paper 3 is conveyed downstream of the cutting position in the cutting unit 9 by the length of the image "D1: C type", as illustrated in FIG. 11. At the timing when the rear end of the image "D1: C type" has moved to a position corresponding to the cutting position in the cutting unit 9, the pinching roller unit 8 is switched over from a state of conveying the paper 3 into a state of holding the paper 3.

As illustrated in FIG. 11, even after the paper 3 is conveyed by the length of the image "D1: C type" (after the rear end of the image "D1: C type" moves to the position corresponding to the cutting position in the cutting unit 9), the lower end of the suspended portion of the paper 3 has reached the sensor position corresponding to the photosensors 70. That is, the quantity of the suspended portion of the paper 2 is kept more than a predetermined value. In this embodiment, as understood from the above description, the predetermined value of the suspended portion of each of the papers 2 and 3 is set so as to equal to the sum of the lengths of two images of "C type", one image of "H type", and one image of "P type". The photosensors 70 are provided so as to correspond to the horizontal level of the lower end of the suspended portion when the quantity of the suspended portion of each of the papers 2 and 3 has reached the predetermined value.

The timing when the pinching roller unit 8 is switched over from a state of not conveying but holding the paper 3 into a state of conveying the paper 3 as described above, is controlled on the basis of detection results of the suspended-portion quantity detection unit 20*c* of the controller 20. In the course of printing by the ink-jet printing unit 6, the suspended-portion quantity detection unit 20*c* of the controller 20 properly performs detecting the quantity of the suspended portion of each of the papers 2 and 3 when the papers 2 and 3 are conveyed by the pinching roller unit 8 by the length of the image printed on the most front side of the suspended portion of each of the papers 2 and 3, and comparing the detected quantity of the suspended portion with the predetermined value.

In the present case, therefore, the quantity of the suspended portion of the paper 3 when the leading end of the paper 3 is conveyed by the length of the image "D1: C type" printed on the most front side of the suspended portion of the paper 3, is detected. At the timing when it is confirmed that the quantity of the suspended portion is more than the predetermined value, switchover of the pinching roller unit 8 is executed. Therefore, as described above, the quantity of the suspended portion of the paper 3 is always kept more than the predetermined value.

Even while the leading end of the paper 3 is conveyed by the pinching roller unit 8 downstream of the cutting position in the cutting unit 9, the paper 3 upstream of the suspended-portion formation unit 7 is being conveyed by the conveyance roller unit 5. Thus, printing on the paper 3 by the ink-jet printing unit 9 is continued without suspension. Therefore, the quantity of the suspended portion of the paper 3 immediately after the leading end of the paper 3 is conveyed as illustrated in FIG. 11 changes in accordance with the conveyance quantities of the paper 3 by the conveyance roller unit 5 and the pinching roller unit 8 at that time.

Figure 12:
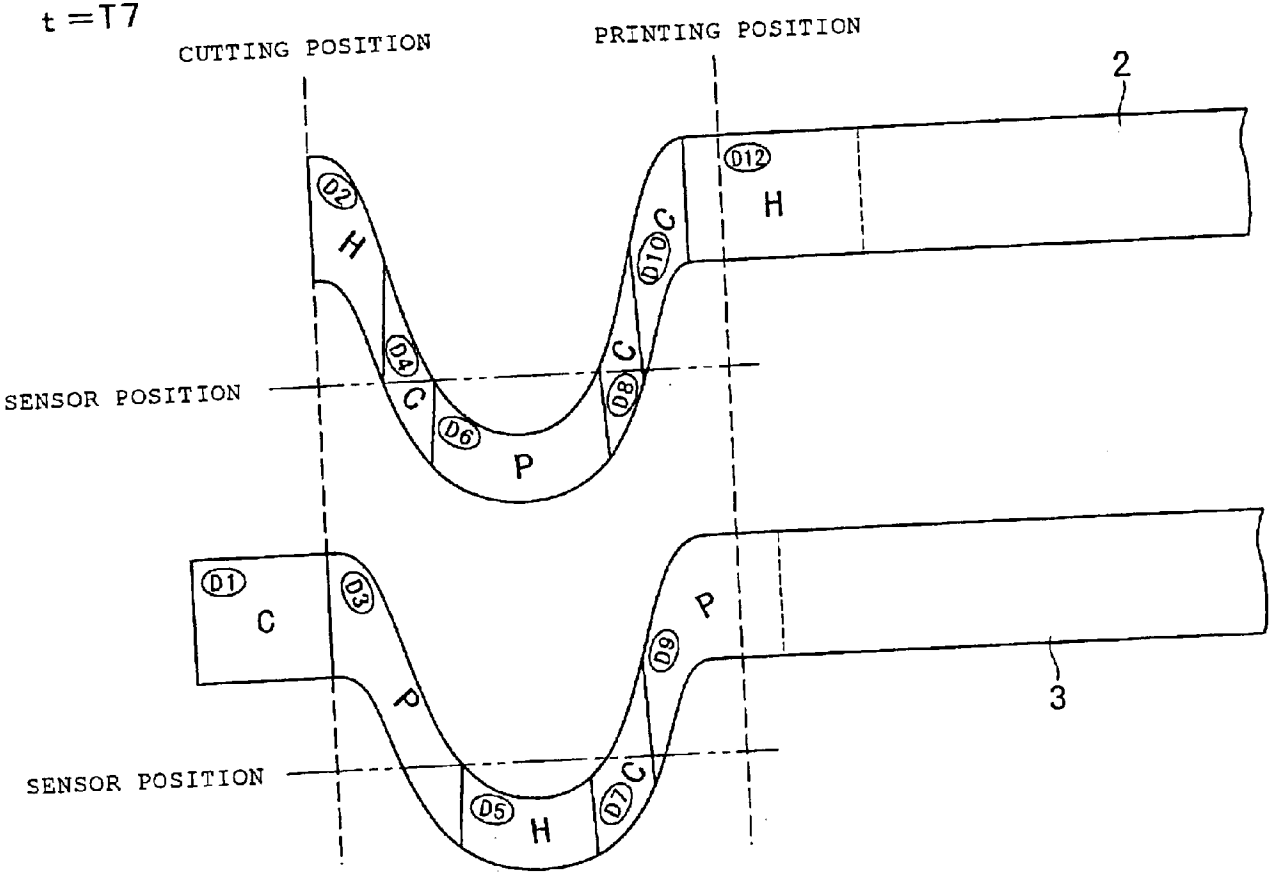
FIG. 12 is a schematic view illustrating a state of each paper in the vicinity of a suspended portion according to the first embodiment.

After this, when printing on the papers 2 and 3 is further continued, the quantity of the suspended portion of each of the papers 2 and 3 again increases gradually. When printing an image in a region having the length corresponding to the difference in length between a "C type" image and an "H type image" from the front end of the sixth image "D12: H type" is completed on the paper 2, the lower end of the suspended portion of the paper 2 has reached a position lower than the sensor position corresponding to the photosensors 70 as illustrated in FIG. 12 (a state at time T7 in FIG. 5) At this time, on the paper 3, printing the fifth image "D9: P type" is halfway.

Figure 13:
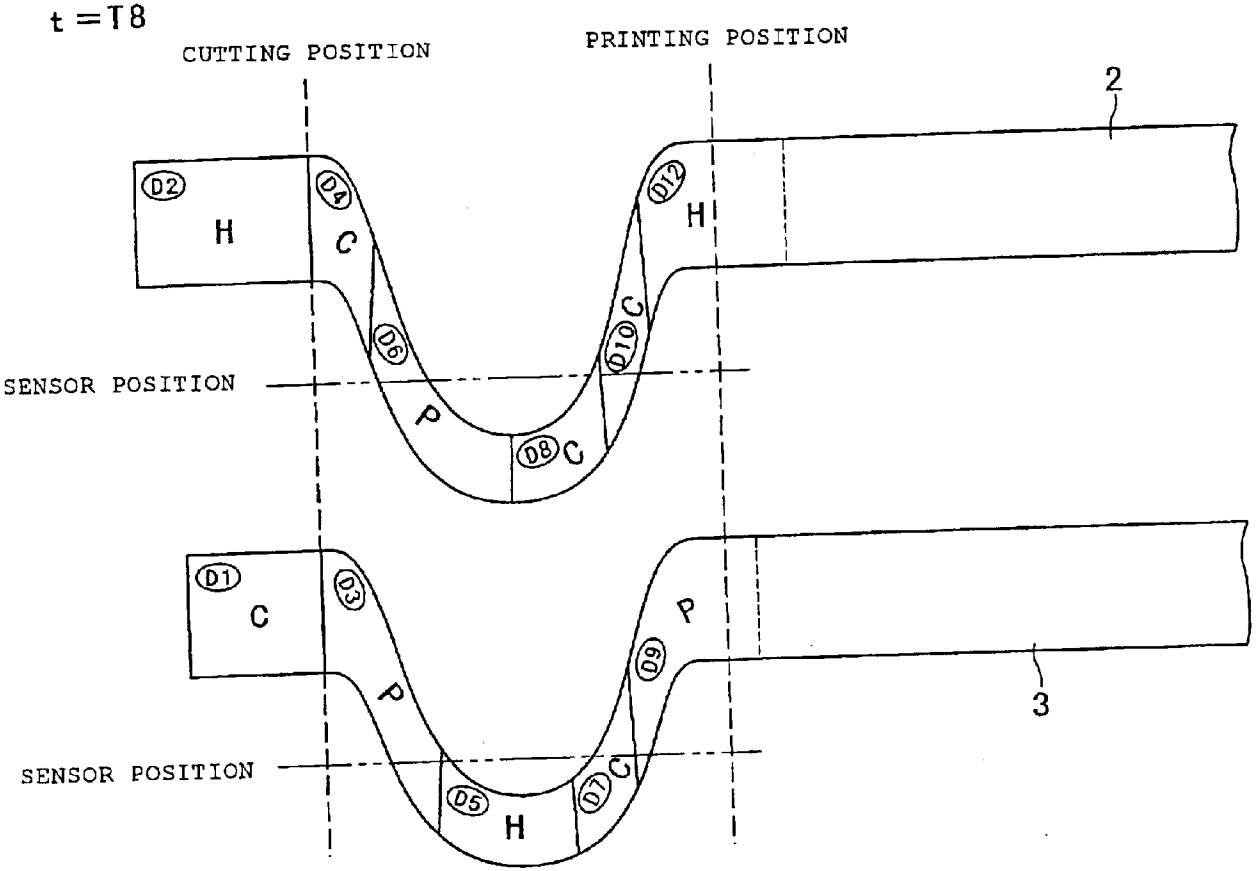
FIG. 13 is a schematic view illustrating a state of each paper in the vicinity of a suspended portion according to the first embodiment.

When the lower end of the suspended portion of the paper 2 has reached the position lower than the sensor position corresponding to the photosensors 70 and the quantity of the suspended portion of the paper 2 has sufficiently increased, that is, even when the leading end of the paper 2 has been conveyed by the length of the image "D2: H type" printed on the most front side of the suspended portion of the paper 2, immediately after it is confirmed that the quantity of the suspended portion of the paper 2 is kept more than the predetermined value, the pinching roller unit 8 is switched over from a state of holding both the papers 2 and 3 into a state of conveying the only paper 2 downstream (a state at time T8 in FIG. 5). At this time, the paper 3 is held by the pinching roller unit 8 in a state wherein the rear end of the image "D1: C type" is at a position corresponding to the cutting position in the cutting unit 9. As a result, as illustrated in FIG. 13, the leading end of the only paper 2 is conveyed downstream of the cutting position in the cutting unit 9 by the length of the image "D2: H type". At the timing when the rear end of the image "D2: H type" reaches a position corresponding to the cutting position in the cutting unit 9, the pinching roller unit 8 is switched over from a state of conveying the paper 2 into a state of holding the paper 2.

As illustrated in FIG. 13, even after the paper 2 is conveyed by the length of the image "D2: H type", the lower end of the suspended portion of the paper 2 has reached the sensor position corresponding to the photosensors 70 and the quantity of the suspended portion of the paper 2 is kept more than the predetermined value.

As described above, the rear ends of the images "D2: H type" and "D1: C type" printed on regions near the leasing ends of the respective papers 3 and 2 are brought at the positions corresponding to the cutting position in the cutting unit 9. In this state, the papers 2 and 3 are cut with the cutting unit 9 substantially at the same time.

In this embodiment, the pinching roller unit 8 is switched over into a state of conveying the only paper 2 downstream after conveying the only paper 3 downstream. But, the pinching roller unit 8 may be switched over into a state of conveying the only paper 3 downstream after conveying the only paper 2 downstream, or a state of simultaneously conveying both the papers 2 and 3 downstream. The conveyance state of the papers 2 and 3 by the pinching roller unit 8 may change in accordance with the length of an image printed on the most front side of the suspended portion of each of the papers 2 and 3, the conveyance rate of each of the papers 2 and 3 by each of the conveyance roller unit 5 and the pinching roller unit 8, etc.

Printing on the papers 2 and 3 is further continued, the quantity of the suspended portion of each of the papers 2 and 3 when the papers 2 and 3 are conveyed by the length of an image printed on the most front side of the suspended portion of each of the papers 2 and 3 is compared with the predetermined value, and then the controller 20 properly switches over the pinching roller unit 8. More specifically, every time when the quantity of the suspended portion of each of the papers 2 and 3 when the papers 2 and 3 are conveyed by the length of an image printed on the most front side of the suspended portion of each of the papers 2 and 3 exceeds the predetermined value, the controller 20 switches over each of the drive roller pairs 8*a* and 8*b* of the pinching roller unit 8 into a state of conveying each of the papers 2 and 3 downstream of the pinching roller unit 8. When the rear end of the image printed near the leading end of each of the papers 2 and 3 has reached a position corresponding to the cutting position in the cutting unit 9, the controller 20 again switches over each of the drive roller pairs 8*a* and 8*b* of the pinching roller unit 8 into a state of not conveying each of the papers 2 and 3 downstream of the pinching roller unit 8.

Every time when the rear ends of images printed in predetermined orders from the leading ends of the papers 2 and 3 are thus aligned at the positions corresponding to the cutting position in the cutting unit 9, the papers 2 and 3 are cut with the cutting unit 9 substantially at the same time. More specifically, the papers 2 and 3 are cut with the cutting unit 9 substantially at the same time, for example, at the rear end of the image "D4: C type" printed second from the leading end of the paper 2 and the rear end of the image "D3: P type" printed second from the leading end of the paper 3, at the rear end of the image "D6: P type" printed third from the leading end of the paper 2 and the rear end of the image "D5: H type" printed third from the leading end of the paper 3, etc.

In this embodiment, when each photosensor 70 does not detect any suspended portion of each of the papers 2 and 3, that is, when the lower end of the suspended portion of each of the papers 2 and 3 has not reached the sensor position corresponding to the photosensors 70, the drive roller pairs 8*a* and 8*b* of the pinching roller unit 8 are not switched over into a state of conveying the papers 2 and 3 downstream of the pinching roller unit 8.

The papers 2 and 3, on which the images D1 to D12 have been printed and which have been cut in the order of photographing of the images recorded on the film 100, are discharged by twos through the discharge port 30*a* of the casing 30 and put on the conveyor belt 80.

In this case, the images D1 to D12 were allotted in order such that the order of an image printed in a predetermined order from the leading end of the paper 3 closer to the tray 85 is one smaller than that of the paper 2. Therefore, the papers 2 and 3 cut with the cutting unit 9 substantially at the same time and discharged through the discharge port 30*a* of the casing 30 substantially at the same time are conveyed toward the tray 85 with the conveyor belt 80, so that they are piled on the tray 85 in the order of a paper 3 on which an image lower in the order of photographing has been printed, and a paper 2 on which an image next in the order of photographing after the image printed on the paper 3 has been printed.

Besides, the images were allotted in order such that the order of images printed on each of the papers 2 and 3 increases by twos toward the tail end of each of the papers 2 and 3. Therefore, the papers 2 and 3 cut with the cutting unit 9 substantially at the same time and discharged through the discharge port 30*a* of the casing 30 substantially at the same the order of images printed on each of the papers 2 and 3 increases by twos toward the tail end of each of the papers 2 and 3. Therefore, the papers 2 and 3 cut with the cutting unit 9 substantially at the same time and discharged through the discharge port 30*a* of the casing 30 substantially at the same time are conveyed toward the tray 85 with the conveyor belt 80, so that they are piled on the tray 85 in the order of a paper 3 on which an image next in the order of photographing after an image printed on a paper 2 piled on the tray 85 immediately before (on the uppermost layer of the papers piled on the tray 85) has been printed, and a paper 2 on which an image next in the order of photographing after the image printed on the paper 3 has been printed.

More specifically, in this embodiment, the papers 2 and 3 are cut with the cutting unit 9 substantially at the same time at the rear end of the image "D1: C type" printed on the paper 3 and the rear end of the image "D2: H type" printed on the paper 2, and discharged through the discharge port 30*a* of the casing 30 substantially at the same time. The cut papers 2 and 3 are conveyed toward the tray 85 with the conveyor belt 80, so that they are piled on the tray 85 in the order of the paper 3 on which the image "D1: C type" has been printed, and the paper 2 on which the image "D2: H type" has been printed.

Subsequently, the papers 2 and 3 are cut with the cutting unit 9 substantially at the same time at the rear end of the image "D3: P type" printed on the paper 3 and the rear end of the image "D4: C type" printed on the paper 2, and discharged through the discharge port 30*a* of the casing 30 substantially at the same time. Like the above, the cut papers 2 and 3 are conveyed toward the tray 85 with the conveyor belt 80, so that they are piled on the paper 2, on which the image "D2: H type" has been printed, in the uppermost layer of the papers piled on the tray 85 in the order of the paper 3 on which the image "D1: C type" has been printed, and the paper 2 on which the image "D2: H type" has been printed. Thus, the papers 2 and 3 on which the images D1 to D12 have been printed are piled on the tray 85 in the order of photographing.

After printing of all images subsequent to the image D12 recorded on the film 100 in this embodiment is completed, till those images are separated by cutting, the papers 2 and 3 may be conveyed without forming suspended portions and cut at the rear end of each image.

In this embodiment, a guillotine cutting unit 9 is provided including movable and fixed cutting edges 9*a* and 9*b* each as a rectangular cutting edge having its length extending over the papers 2 and 3 disposed in two lines. Thus, in comparison with another construction, since the time for cutting the papers 2 and 3 can be shortened, the efficiency is good. This is suitable in case of an ink-jet printer 1 to be operated at a high speed for a large amount of images. In addition, this is suitable also in case of cutting a relatively thick paper.

Besides, in this embodiment, the pressing members 61 and 62 of the suspended-portion formation unit 7 can apply forces to the papers 2 and 3 such that the suspended portion of each of the papers 2 and 3 is always formed below the conveyance plane of the papers 2 and 3. Therefore the suspended portion of each of the papers 2 and 3 can surely be formed below the conveyance plane. Thus, a space for receiving the suspended portion of each of the papers 2 and 3 in the ink-jet printer 1 may be provided in an only predetermined direction relative to the conveyance plane of the papers 2 and 3.

Further, in this embodiment, the conveyance roller unit 5 is disposed upstream of the suspended-portion formation unit 7 and the pinching roller unit 8 is disposed downstream of the suspended-portion formation unit 7. The conveyance roller unit 5 and the pinching roller unit 8 can independently convey the papers 2 and 3. Thus, the suspended portion of each of the papers 2 and 3 can easily be formed.

As described above, according to the ink-jet printer 1 of this embodiment, images are printed in the order of photographing with being allotted such that the order of an image printed in a predetermined order from the leading end of the paper 3 closer to the tray 85 is one lower than that of the paper 2, and such that the order of images printed on each of the papers 2 and 3 gradually increases by twos toward the tail end of each of the papers 2 and 3. Further, the papers 2 and 3 cut with the cutting unit 9 after each image is printed are conveyed with the conveyor belt 80 and then piled on the tray 85 in the order of photographing. Therefore, the papers 2 and 3 conveyed after the images are printed and then piled one on another are prevented from being rearranged in the order of photographing.

Besides, with forming a suspended portion of each of the papers 2 and 3, only one of the papers 2 and 3 can be conveyed downward of the pinching roller unit 8. Therefore, in case of printing images including images of "C type", "H type", and "P type" different in length, on the papers 2 and 3 in sequence, printing images by the ink-jet printing unit 6 may not be suspended. Thus, reduction of the processing performance of the ink-jet printer 1 can be prevented.

Further, in case of printing images including images of "C type", "H type", and "P type" different in length, in sequence on the papers 2 and 3 disposed in parallel, since the rear ends of images printed near the leading ends of the papers 2 and 3 are aligned at the cutting position in the cutting unit 9, it does not occur that only one of the papers 2 and 3 is cut with the cutting unit 9. The papers 2 and 3 are cut with the cutting unit 9 substantially at the same time. Therefore, in comparison with a case wherein the papers 2 and 3 are independently cut by images printed thereon for example, the number of cutting operations of the cutting unit 9 to the papers 2 and 3 can be reduced. In addition, occurrence of "cut the air" of the cutting unit 9 in the conveyance path of any of the papers 2 and 3 can be suppressed. Thus, reduction of the cutting performance to the papers 2 and 3, and reduction of the duration of the cutting unit 9, or deterioration of the movable and fixed cutting edges 9*a* and 9*b* of the cutting unit 9 can be suppressed. As a result, the life of the cutting unit 9 can be elongated. In addition, since the number of cutting operations of the cutting unit 9 to the papers 2 and 3 is reduced, an effect can be obtained that the noise upon operation of the cutting unit 9 is reduced.

Further, since images are allotted alternately to the papers 2 and 3, the number of images allotted to the paper 3 is the same as that to the paper 2, or the former is one larger than the latter. Therefore, in comparison with a case wherein the number of images on one paper is greatly larger than that on the other paper for example, the number of cutting operations of the cutting unit 9 to the papers 2 and 3 can be reduced more effectively. In addition, occurrence of "cut the air" of the cutting unit 9 in the conveyance path of any of the papers 2 and 3 can be suppressed more effectively. Besides, the time for printing the images by the ink-jet printing unit 6 can be shortened. This can improve the processing performance of the ink-jet printer 1.

Further, there is actually no case wherein the first cutting operation for one of the papers 2 and 3 starts after all cutting operations for the other are completed, for example. The papers 2 and 3 are cut substantially at the same time. Therefore, the quantity of the suspended portion of each of the papers 2 and 3 is apt to be relatively small. Thus, the space for receiving the suspended portion of each of the papers 2 and 3 can be made small. This can reduce the size of the ink-jet printer 1.

Further, the cutting unit 9 includes the movable and fixed cutting edges 9*a* and 9*b* each having its length extending over the papers 2 and 3. Therefore, any of the papers 2 and 3 can be cut with the pair of cutting edges at the rear end of each image. Thus, in comparison with a case wherein the cutting unit 9 includes a pair of cutting edges for each of the papers 2 and 3, produce of an excessive manufacture cost can be suppressed. Further, also to a wide paper having the same width as the whole width of the conveyance path of the papers 2 and 3, printing each image and cutting at the rear end of each image can properly be performed.

Next, a second embodiment of the present invention will be described with reference to FIGS. 1, 3, and 14 to 24.

Figure 14:
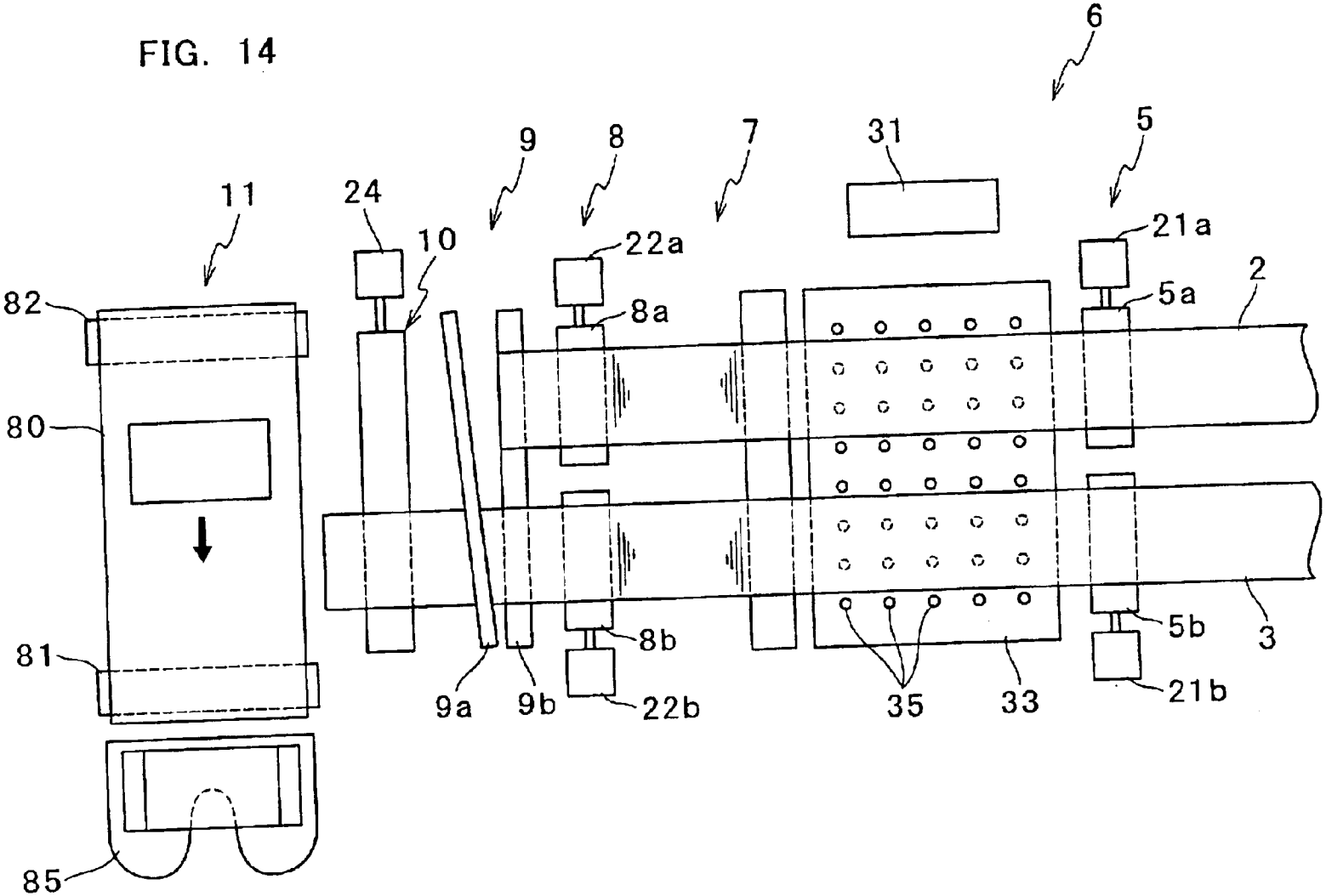
FIG. 14 is a plan view of an ink-jet printer according to a second embodiment of the present invention.

An ink-jet printer of the second embodiment differs from the ink-jet printer 1 of the first embodiment in allotment of images by the image allotment unit 20*b* and the following feature. That is, in the ink-jet printer 1 of the first embodiment, the papers 2 and 3 are cut substantially at the same time at the rear end of each image printed near the leading end of each of the papers 2 and 3. Contrastingly in the ink-jet printer of the second embodiment, the papers 2 and 3 are cut independently of each other at the rear end of each image printed near the leading end of each of the papers 2 and 3. The construction of the ink-jet printer of the second embodiment as illustrated in FIG. 14 is substantially the same as that of the ink-jet printer 1 of FIG. 2. Therefore, in FIG. 14, the same components as in FIG. 2 are denoted by the same reference numerals as in FIG. 2, thereby omitting the description.

The image allotment unit 20*b* of the controller 20 of the ink-jet printer of the second embodiment allots images, which are in the order of photographing, in sequence to one of the papers 2 and 3 in which the sum of the length of images along the length of each of the papers 2 and 3 (hereinafter simply referred to as "image length") having been allotted to the paper is shorter than that of the other paper. This allotment by the image allotment unit 20*b* of this embodiment will be described later in detail.

Next, an operation of the ink-jet printer of the second embodiment will be described with reference to FIGS. 15 to 24.

First, as illustrated in FIG. 1, when the motors 21*a* and 21*b* drive the respective drive roller pairs 5*a* and 5*b* of the conveyance roller unit 5, the papers 2 and 3 being pinched by the respective drive roller pairs 5*a* and 5*b* are taken out from the rolls 2*a* and 3*a*. The papers 2 and 3 are conveyed from their respective leading ends onto the suction plate 33 in order.

Subsequently, when the papers 2 and 3 are conveyed downstream substantially at the same speed with being sucked to the suction holes 35, a region in the vicinity of the leading end of each of the papers 2 and 3 reaches the printable area opposite to the printing head 31. At this time, either of the papers 2 and 3 on the suction plate 33 is sucked onto the suction plate 33 through the suction holes 35 by the suction fan 34.

Printing of images is performed onto each of the papers 2 and 3 with conveying the papers 2 and 3 and alternately repeating forward and backward movements of the printing head 31 perpendicular to the conveyance direction of the papers 2 and 3. At this time, the printing head 31 is moved forward and backward in a range wider than the interval between the outer ends of the papers 2 and 3 in their widths. Printing of images may be performed upon the only forward movement of the printing head 31 or upon both the forward and backward movements of the printing head 31.

Figure 15:
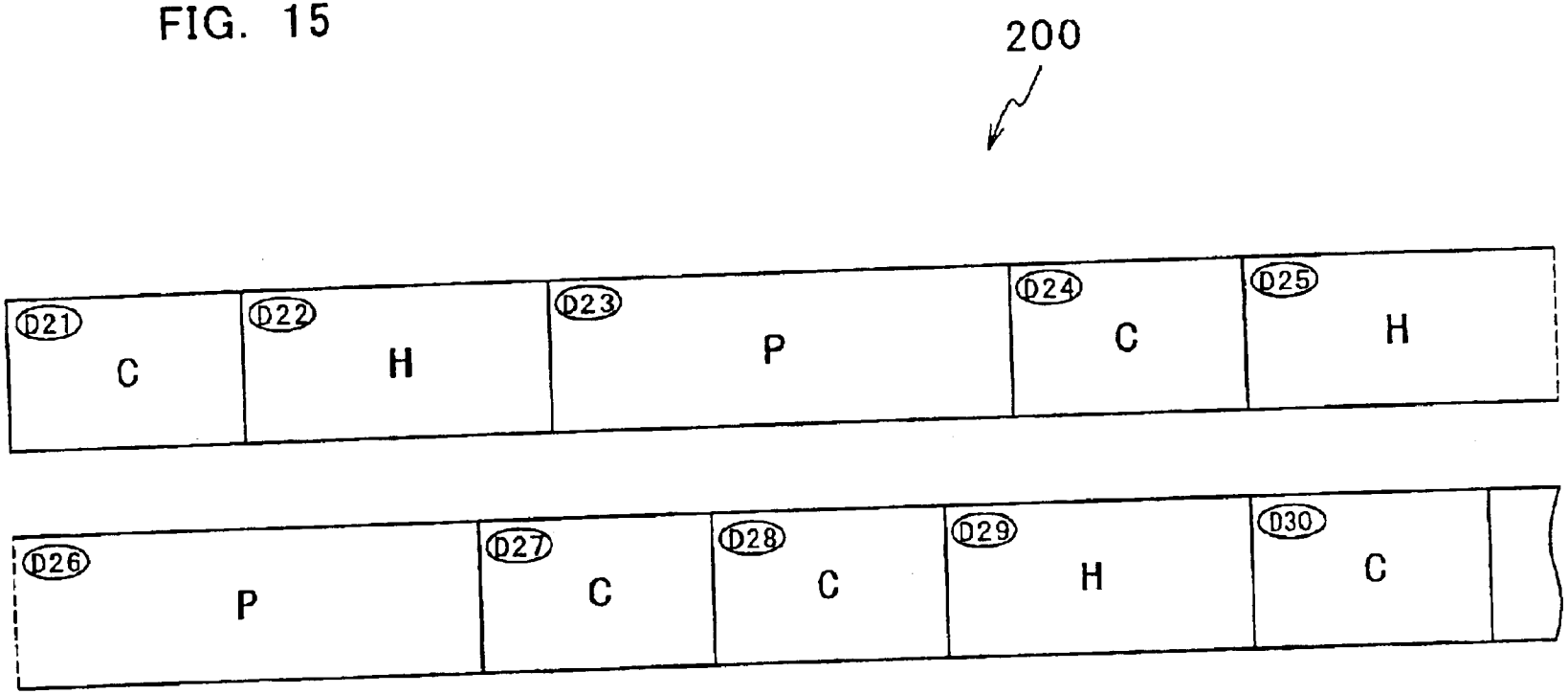
FIG. 15 is a schematic plan view of a film recorded thereon image data according to the second embodiment.

Image data in this embodiment is based on image data recorded on one film 200 as illustrated in FIG. 15. FIG. 15 schematically illustrates the photographing order and the print types of images recorded on the film 200. FIG. 15 illustrates only top ten of images recorded on the film 200. In this embodiment, a printing operation of these ten images will be described. In FIG. 15, references D21, D22, D23, . . . , indicate the photographing order, and they may be used for indicating the respective images.

On the film 200, images to be printed in different print types are recorded together. Print types are the same as in the first embodiment so detailed description thereof is omitted here.

As illustrated in FIG. 15, on the film 200 of this embodiment, from its leading end, images are recorded in sequence to be printed in print types of "D21: C type", "D22: H type", "D23: P type", "D24: C type", "D25: H type", "D26: P type", "D27: C type", "D28: C type", "D29: H type", and "D30: C type". Each of the images D21 to D30 is printed in order with being allotted to each of the papers 2 and 3 in the order of photographing.

Allotment of images by the image allotment unit 20*b* will be described in detail with reference to FIG. 16.

As described above, the image allotment unit 20*b* allots each of the images D21 to D30 recorded on the film 200, in the order of photographing, to one of the papers 2 and 3 in which the sum of the image lengths having been allotted to the paper is shorter than that of the other paper. That is, every time when the next image is allotted, the sum of the image lengths allotted to the paper 2 and the sum of the image lengths allotted to the paper 3 at the time when the preceding image was allotted are compared with each other.

First, upon the start of printing, the top image "D21: C type" is allotted to the paper 3. That is, the image "D21: C type" is printed in a range near the leading end of the paper 3. At the time when the image "D21: C type" is allotted to the paper 3, no image is allotted to the paper 2. Thus, the sum of the image lengths having been allotted to the paper 2 is zero. On the other hand, since only one image "D21: C type" has been allotted to the paper 3, the sum of the image lengths having been allotted to the paper 3 is equal to the length of the image "D21: C type". Therefore, the next image "D22: H type" is allotted to the paper 2 shorter in the sum of the image lengths. That is, the image "D22: H type" is printed in a range near the leading end of the paper 2.

In this embodiment, the top image "D21: C type" recorded on the film 200 is allotted to the paper 3. But, the present invention is not limited to this feature. The top image may be allotted to the paper 2. That is, upon the start of printing, since either of the sum of the image lengths having been allotted to the paper 2 and the sum of the image lengths having been allotted to the paper 3 is zero, both are the same. Thus, it can not be determined in which of the papers 2 and 3 the sum of the image lengths is shorter. In this case, therefore, the image may be allotted to any of the papers 2 and 3. Also, at the time when images were allotted to each of the papers 2 and 3, when the sum of the image lengths having been allotted to the paper 2 is the same as the sum of the image lengths having been allotted to the paper 3, the next image may be allotted to any of the papers 2 and 3.

At the time when the image "D22: H type" was allotted to the paper 2, only one image "D22: H type" was allotted to the paper 2. Thus, the sum of the image lengths having been allotted to the paper 2 is equal to the length of the image "D22: H type". On the other hand, since only one image "D21: C type" was allotted to the paper 3, the sum of the image lengths having been allotted to the paper 3 is equal to the length of the image "D21: C type". Therefore, the next image "D23: P type" is allotted to the paper 3 shorter in the sum of the image lengths. That is, the image "D23: P type" is printed on the rear side of the region where the image "D21: C type" was printed.

At the time when the image "D23: P type" was allotted to the paper 3, only one image "D22: H type" was allotted to the paper 2. Thus, the sum of the image lengths having been allotted to the paper 2 is equal to the length of the image "D22: H type". On the other hand, two images "D21: C type" and "D23: P type" were allotted to the paper 3. Thus, the sum of the image lengths having been allotted to the paper 3 is equal to the sum of the lengths of the images "D21: C type" and "D23: P type". Therefore, the next image "D24: C type" is allotted to the paper 2 shorter in the sum of the image lengths. That is, the image "D24: C type" is printed on the rear side of the region where the image "D22: H type" was printed.

Subsequently, like the above, each of the images D25 to D30 is allotted to one of the papers 2 and 3. As a result, as illustrated in FIG. 16, to the paper 2, from its leading end, the images "D22: H type", "D24: C type", "D25: H type", "D27: C type", "D28: C type", and "D30: C type" are allotted in this order. On the other hand, to the paper 3, from its leading end, the images "D21: C type", "D23: P type", "D26: P type", and "D29: H type" are allotted in this order.

Hereinafter, an operation after regions near the leading ends of the papers 2 and 3 have reached the printable region and printing images on the papers 2 and 3 is started, will be described with reference to FIGS. 17 to 24 each illustrating a state of a suspended portion of each of the papers 2 and 3.

Figure 16:
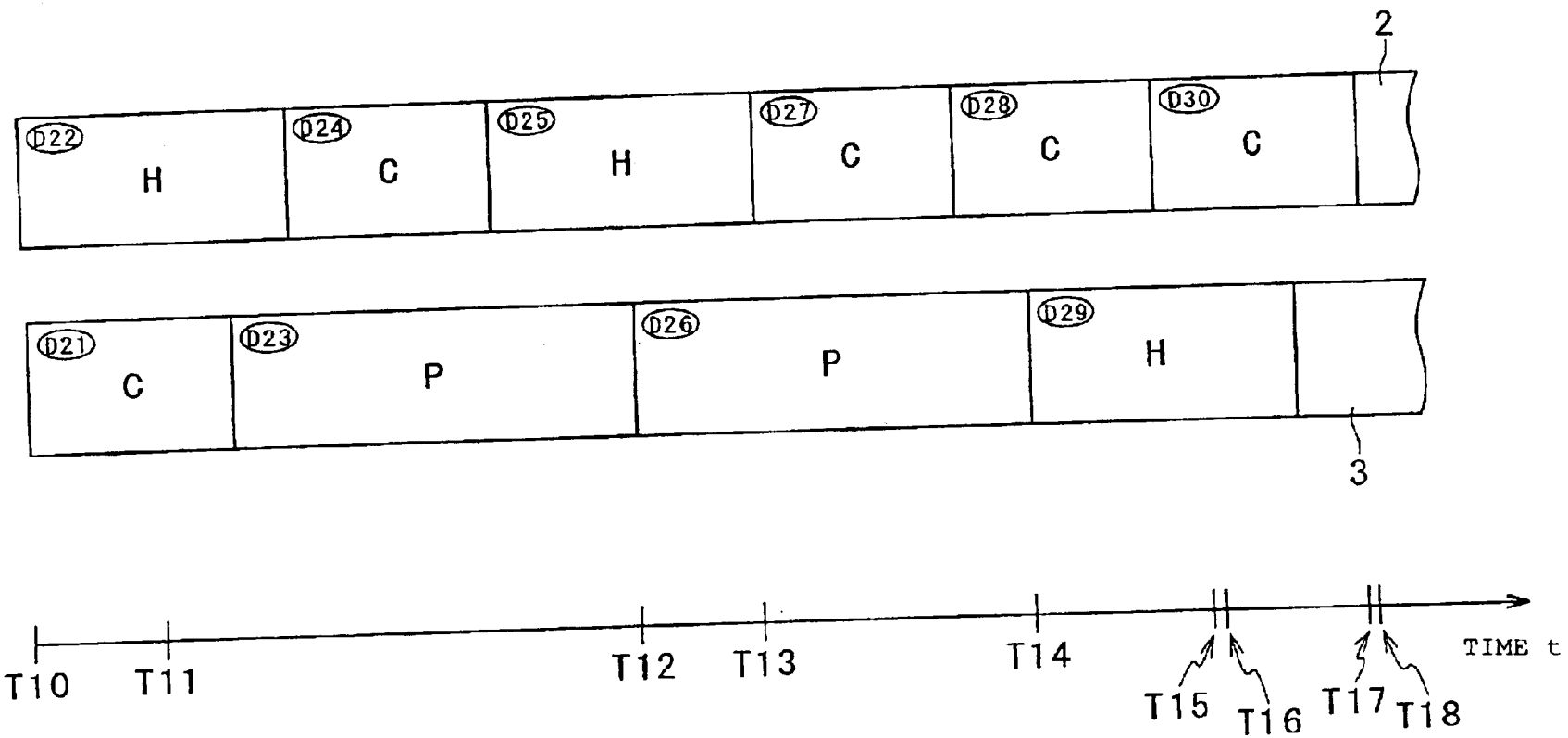
FIG. 16 is a schematic view for explaining allotment of images to two papers according to the second embodiment.

A time axis in FIG. 16 shows the time elapse from the start of printing. Positions on the time axis correspond to the positions of the respective images D21 to D30 allotted to the papers 2 and 3. That is, at time T10 (the start of printing), printing the image D22 is started from the leading end of the paper 2 and printing the image D21 is started from the leading end of the paper 3. Further, at time T13 for example, printing the images D22, D24, and D25 has been completed on the paper 2, printing the images D21 and D23 has been completed on the paper 3, and printing the image D26 on the paper 3 is halfway.

FIGS. 17 to 24 illustrate a state of a suspended portion of each of the papers 2 and 3 at each of times T11 to T18 in FIG. 16. In FIGS. 17 to 24, like in FIGS. 6 to 13, the position of an end of the printable region in the ink-jet printing unit 6 on the downstream direction of the paper flow is indicated as "printing position", a position where the papers 2 and 3 are to be cut by the cutting unit 9 is indicated as "cutting position" (the above two are shown with broken lines), and a position corresponding to the photosensors 70 is indicated as "sensor position" (this is shown with an alternate long and two dashes line).

Figure 17:
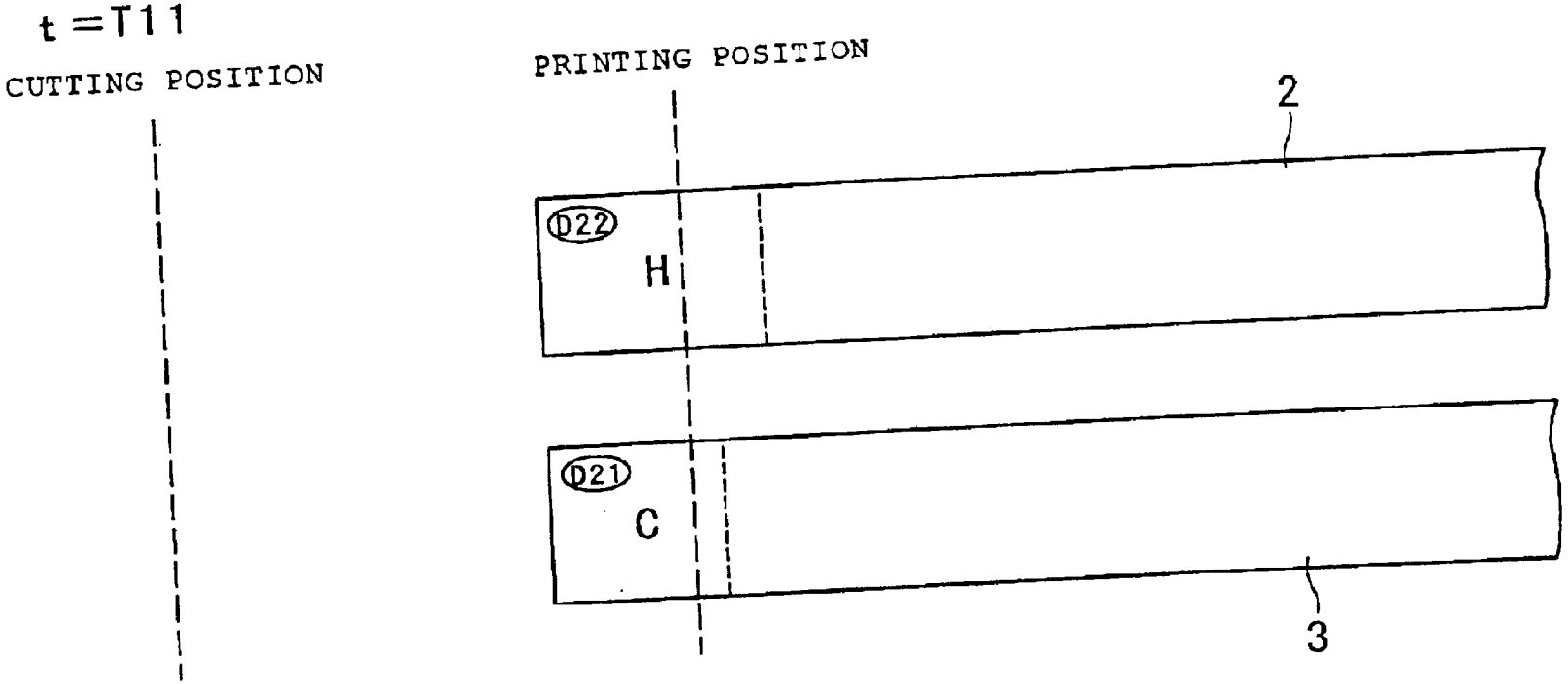
FIG. 17 is a schematic view illustrating a state of each paper in the vicinity of a suspended portion according to the second embodiment.

When regions near the leading ends of the papers 2 and 3 reach the printable region, printing on the papers 2 and 3 is started (a state at time T10 in FIG. 16). While the papers 2 and 3 are conveyed substantially at the same speed, as illustrated in FIG. 17, printing the image "D21: C type" on a region near the leading end of the paper 3 and printing the image "D22: H type" on a region near the leading end of the paper 2 are performed substantially at the same time (a state at time T11 in FIG. 16).

Figure 18:
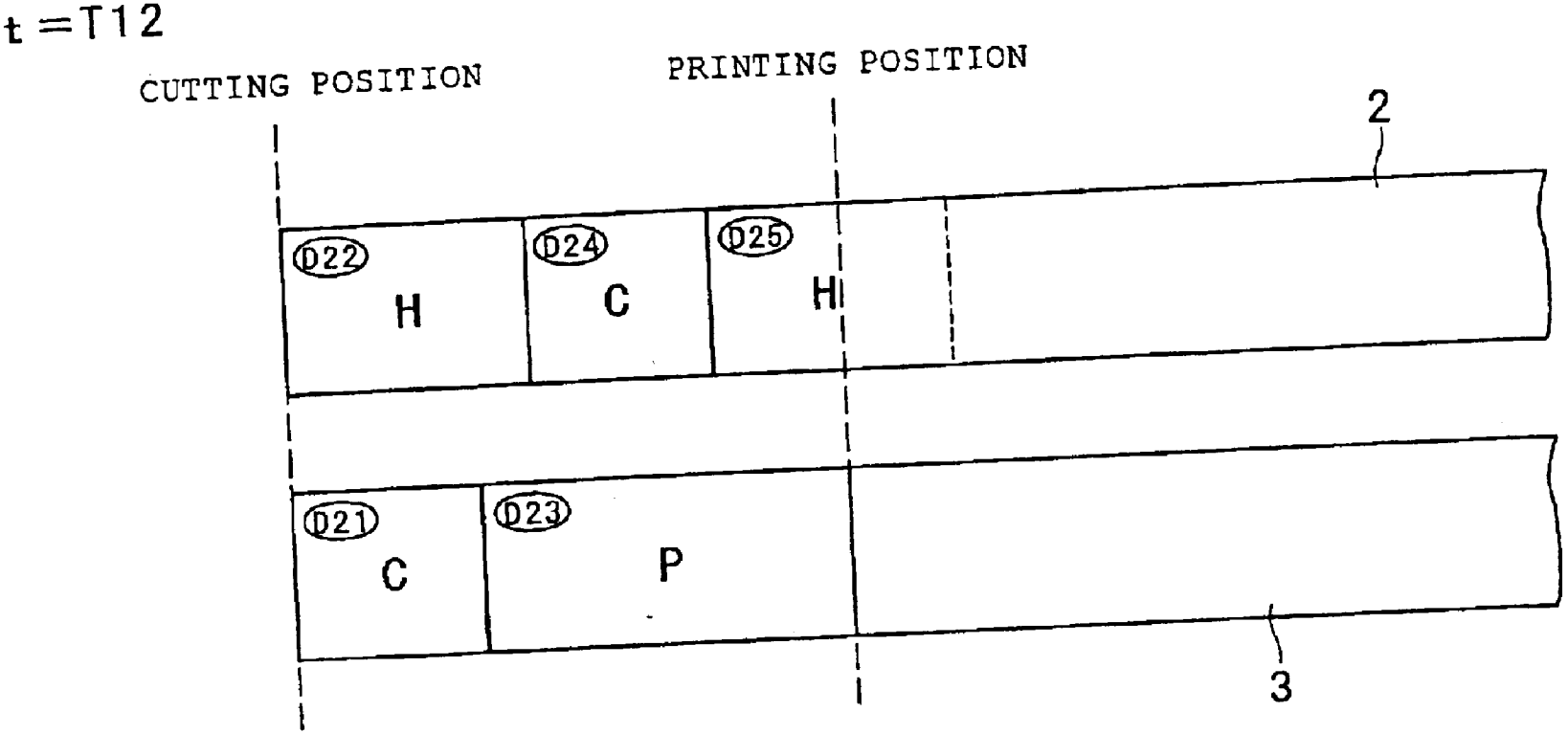
FIG. 18 is a schematic view illustrating a state of each paper in the vicinity of a suspended portion according to the second embodiment.

After this, when printing on the papers 2 and 3 is continued and printing the images "D21: C type" and "D23: P type" has been completed, the leading end of the paper 3 reaches the cutting position in the cutting unit 9 as illustrated in FIG. 18 (a state at time T12 in FIG. 16). At this time, on the paper 2, printing the images "D22: H type" and "D24: C type" was completed and printing the image "D25: H type" is halfway. Like the paper 3, also the leading end of the paper 2 has reached the cutting position in the cutting unit 9.

In the printing operation from the state at time T10 upon the start of printing to the state at time T12, the papers 2 and 3 are conveyed downstream by the conveyance roller unit 5. After printing is completed, the papers 2 and 3 being conveyed between the ink-jet printing unit 6 and the pinching roller unit 8 are being conveyed between the upper and lower guides 51 and 52 of the guide unit 50 of the suspended-portion formation unit 7. At this time, the papers 2 and 3 are pinched by the rollers 41 and 45 of the roller unit 40 and pressed onto the lower guide 52 by the rollers 61*b* and 62*b* of the pressing members 61 and 62 of the auxiliary unit 60 that have enter downward the openings 51*a* of the upper guide 51.

At this time, either of the drive roller pairs 8*a* and 8*b* of the pinching roller unit 8 is driven to rotate in the conveyance direction of the papers 2 and 3. Thus, when the leading ends of the papers 2 and 3 reach the drive roller pairs 8*a* and 8*b*, the papers 2 and 3 are pinched by the drive roller pairs 8*a* and 8*b* and conveyed downstream. After this, when either of the leading ends of the papers 2 and 3 reaches the cutting position in the cutting unit 9, the controller 20 stops to drive the drive roller pairs 8*a* and 8*b* of the pinching roller unit 8. Thus, the regions near the leading ends of the papers 2 and 3 are held by the pinching roller unit 8 not to be conveyed downstream of the pinching roller unit 8.

At time T12 when either of the leading ends of the papers 2 and 3 reaches the cutting position in the cutting unit 9, when the controller 20 drives the motor 68 of the suspended-portion formation unit 7, the board 64 is rotated to move the lower guide 52 into a substantially vertical posture, as described above. When the lower guide 52 is thus moved into a substantially vertical posture, the movements in the biased direction of the rollers 61*b* and 62*b* of the pressing members 61 and 62 are not stopped by the lower guide 52. Hence, the pressing members 61 and 62 rotate around the shaft 63. Therefore, the rollers 61*b* and 62*b* of the pressing members 61 and 62 that have pressed the papers 2 and 3 onto the lower guide 52 push the papers 2 and 3 downward of the conveyance plane of the papers 2 and 3.

In this embodiment, at the timing when either of the leading ends of the papers 2 and 3 has reached the cutting position in the cutting unit 9, the pinching roller unit 8 is stopped to be driven and the lower guide 52 is moved into a substantially vertical posture. But, in a modification, at the timing when the leading ends of the papers 2 and 3 has reached the pinching roller unit 8 and they are pinched by the pinching roller unit 8, the pinching roller unit 8 may be stopped to be driven and the lower guide 52 may be moved into a substantially vertical posture. That is, even when the papers 2 and 3 are pushed by the pressing members 61 and 62 downward of the conveyance plane of the papers 2 and 3 and the leading ends of the papers 2 and 3 are pulled upstream in the conveyance direction of the papers 2 and 3, it is preferable that the lower guide 52 is moved into a substantially vertical posture after the leading ends of the papers 2 and 3 are held so as to hardly change their positions.

Figure 19:
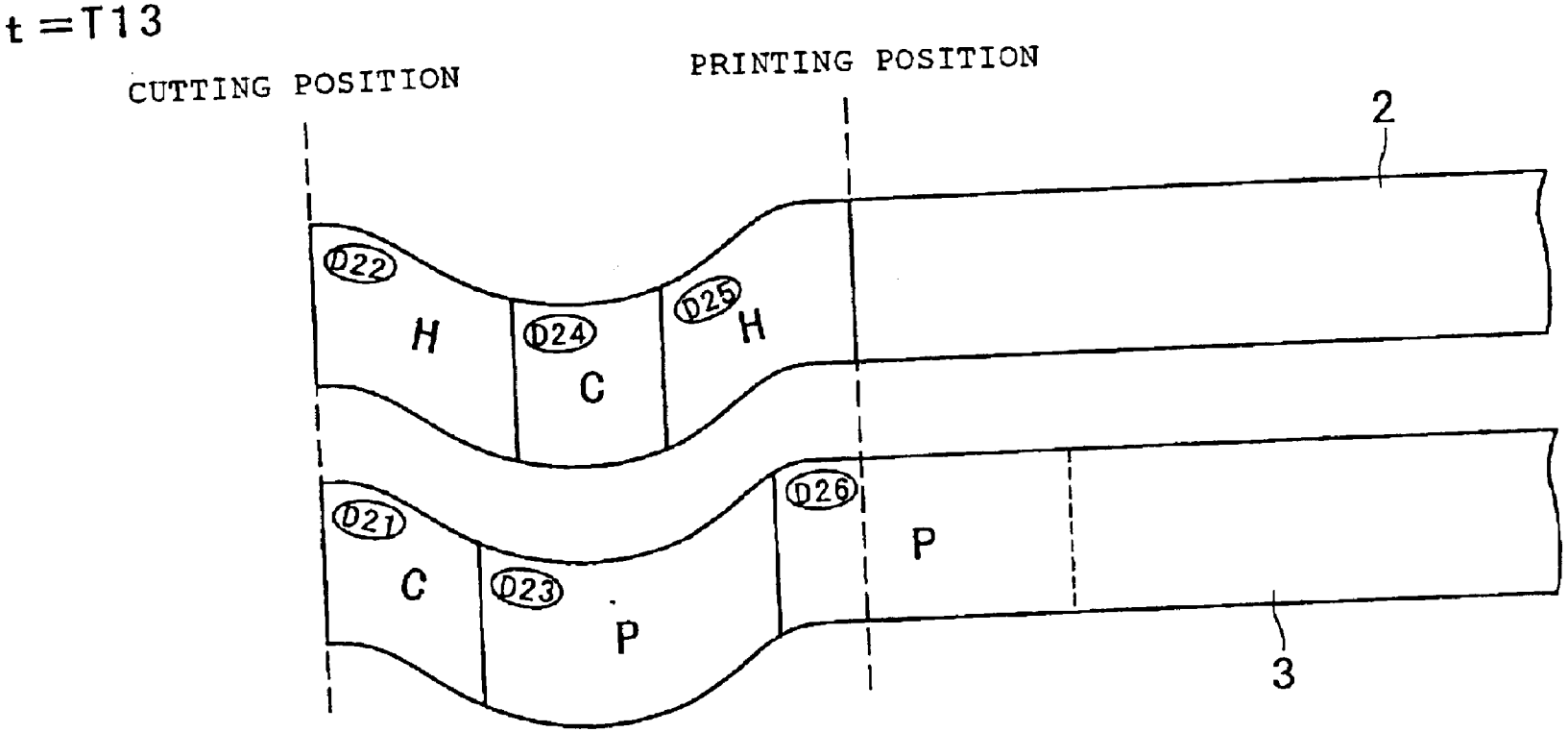
FIG. 19 is a schematic view illustrating a state of each paper in the vicinity of a suspended portion according to the second embodiment.

In a state that the papers 2 and 3 are held by the pinching roller unit 8 so as not to be conveyed downstream of the pinching roller unit 8 and the papers 2 and 3 are pushed downward of the conveyance plane by the pressing members 61 and 62 of the suspended-portion formation unit 7, when conveyance by the conveyance roller unit 5 and printing are continued, each of the papers 2 and 3 forms a suspended portion in the suspended-portion formation unit 7 as illustrated in FIG. 19 (a state at time T13 in FIG. 16).

Figure 20:
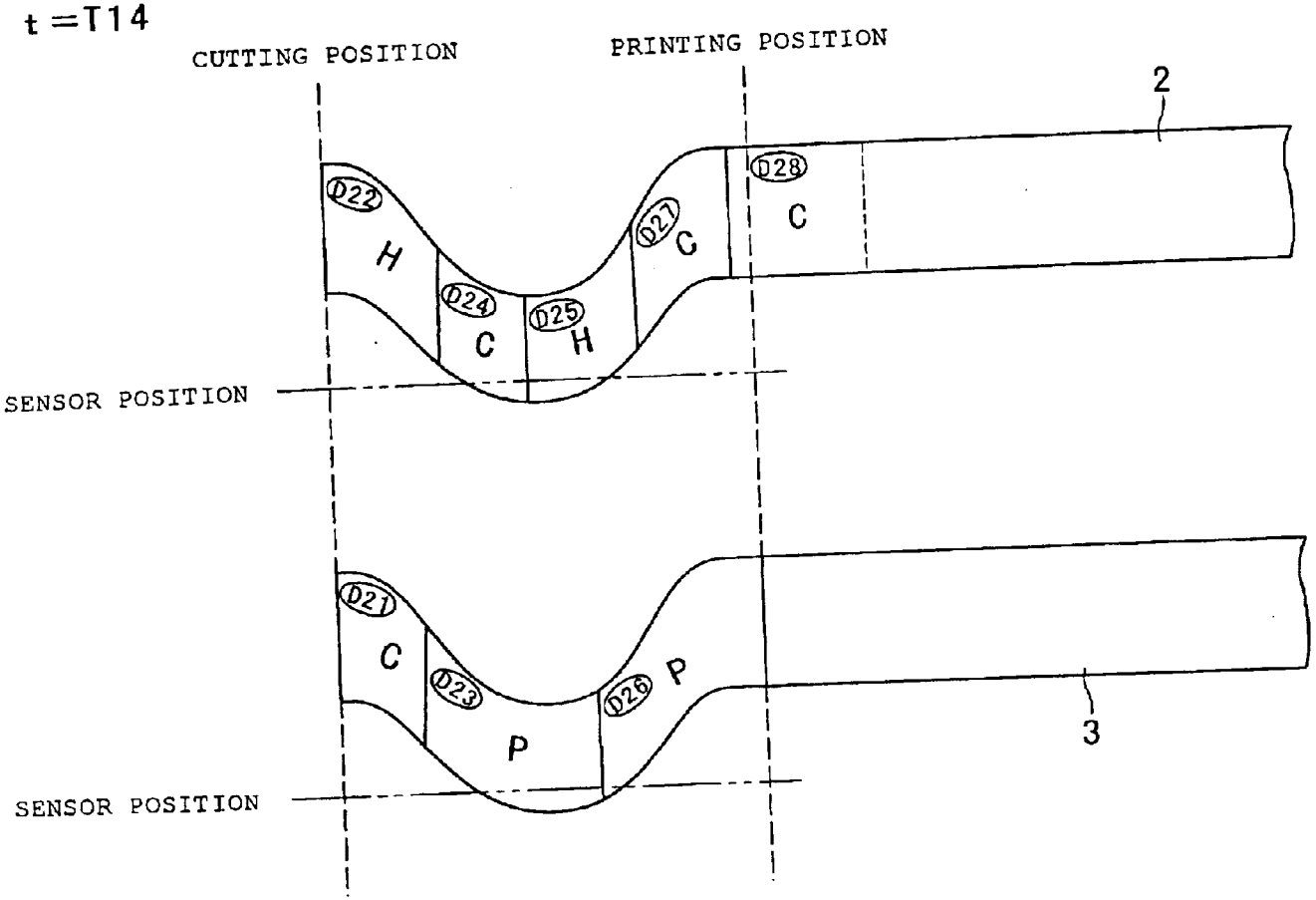
FIG. 20 is a schematic view illustrating a state of each paper in the vicinity of a suspended portion according to the second embodiment.

After this, when printing on the papers 2 and 3 is further continued and printing the third image "D26: P type" on the paper 3 is completed, the lower end of the suspended portion of the paper 3 reaches the sensor position corresponding to the photosensors 70 as illustrated in FIG. 20 (a state at time T14 in FIG. 16). At this time, on the paper 2, printing the fifth image "D28: C type" is halfway. Like the paper 3, also the lower end of the suspended portion of the paper 2 has reached the sensor position corresponding to the photosensors 70. That is, the quantities of the suspended portions of the papers 2 and 3 at this time are substantially the same.

Figure 21:
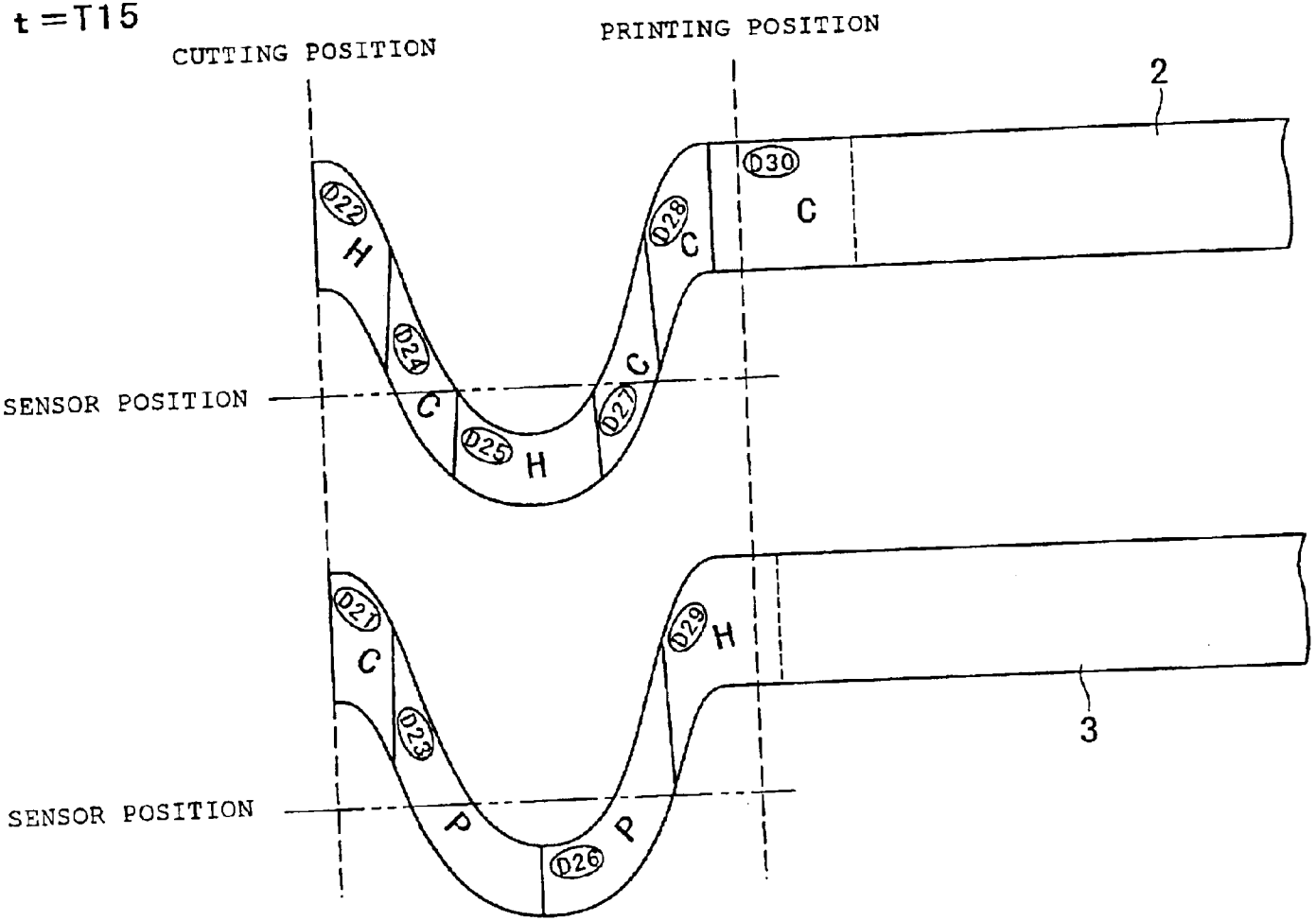
FIG. 21 is a schematic view illustrating a state of each paper in the vicinity of a suspended portion according to the second embodiment.

When printing on the papers 2 and 3 is further continued, the quantities of the suspended portions of the papers 2 and 3 increase gradually. When printing an image in a region having the same length as the image "D21: C type" from the front end of the fourth image "D29: H type" on the paper 3 is completed, the lower end of the suspended portion of the paper 3 reaches a position lower than the sensor position corresponding to the photosensors 70 as illustrated in FIG. 21 (a state at time T15 in FIG. 16). At this time, on the paper 2, printing the sixth image "D30: C type" is halfway. Like the paper 3, also the lower end of the suspended portion of the paper 2 has reached a position lower than the sensor position corresponding to the photosensors 70.

Figure 22:
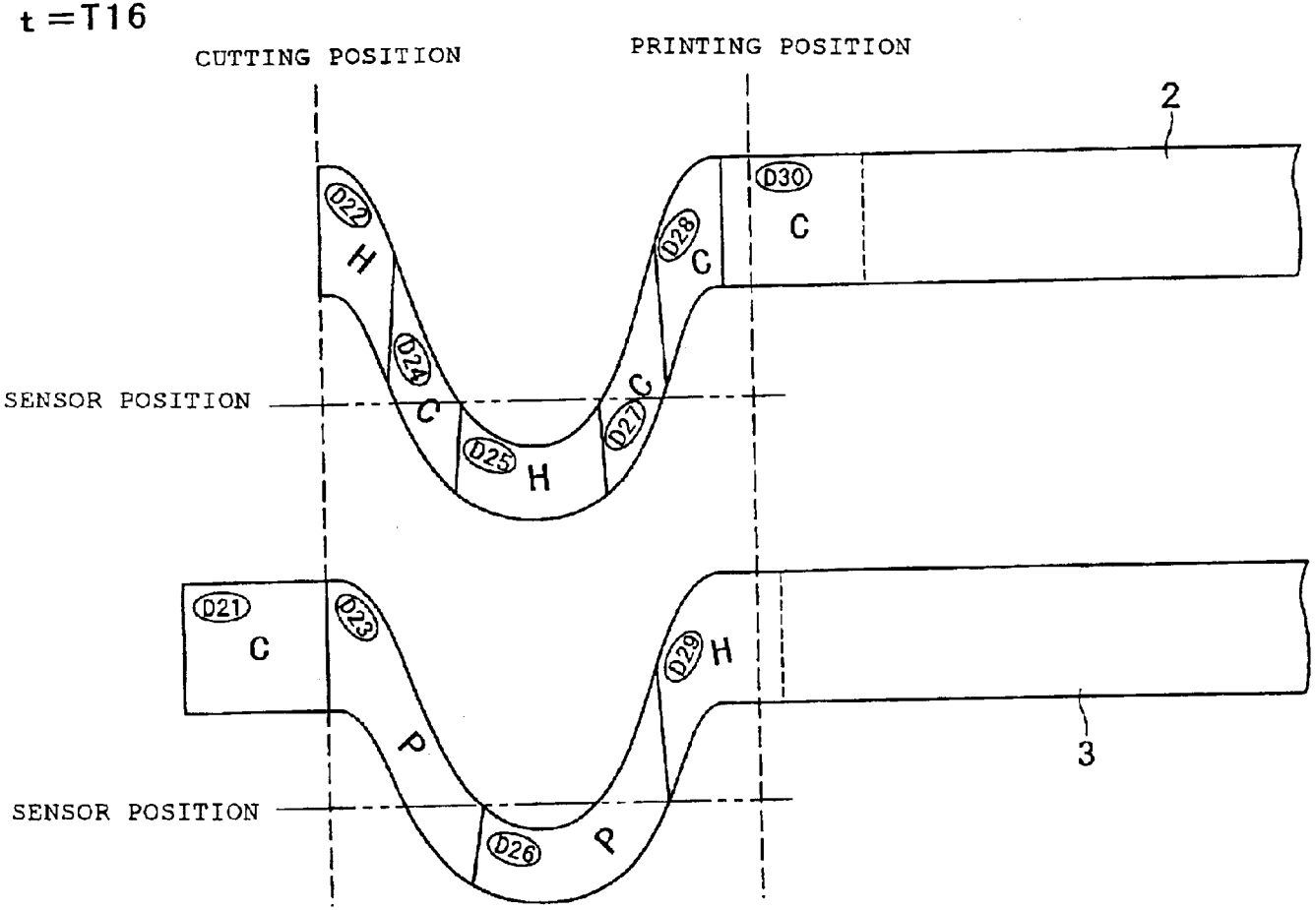
FIG. 22 is a schematic view illustrating a state of each paper in the vicinity of a suspended portion according to the second embodiment.

Immediately after the lower end of the suspended portion of the paper 3 reaches a position lower than the sensor position corresponding to the photosensors 70 and the quantity of the suspended portion of the paper 3 has sufficiently increased, the pinching roller unit 8 is switched over from a state of holding both the papers 2 and 3 into a state of conveying the only paper 2 downstream (a state at time T16 in FIG. 16). As a result, the leading end of the only paper 3 is conveyed downstream of the cutting position in the cutting unit 9 by the length of the image "D21: C type", as illustrated in FIG. 22. The rear end of the image "D21: C type" is thereby brought at a position corresponding to the cutting position in the cutting unit 9 and the paper 3 is cut at the rear end of the image "D21: C type". Printing and cutting off the image "D21: C type" are thus completed. At the timing when the leading end of the paper 3 is conveyed by the length of the image "D21: C type", the pinching roller unit 8 is switched over from a state of conveying the paper 3 into a state of holding the paper 3.

As illustrated in FIG. 22, even after the paper 3 is conveyed by the length of the image "D21: C type" (after the image "D21: C type" is cut off), the lower end of the suspended portion of the paper 3 has reached the sensor position corresponding to the photosensors 70. That is, the quantity of the suspended portion of the paper 2 is kept more than a predetermined value. In this embodiment, as understood from the above description, the predetermined value of the suspended portion of each of the papers 2 and 3 is set so as to equal to the sum of the lengths of the images "D21: C type", "D23: P type", and "D26: P type". The photosensors 70 are provided so as to correspond to the horizontal level of the lower end of the suspended portion when the quantity of the suspended portion of each of the papers 2 and 3 has reached the predetermined value.

The timing when the pinching roller unit 8 is switched over from a state of not conveying but holding the paper 3 into a state of conveying the paper 3 as described above, is controlled on the basis of detection results of the suspended-portion quantity detection unit 20*c* of the controller 20. In the course of printing by the ink-jet printing unit 6, the suspended-portion quantity detection unit 20*c* of the controller 20 properly performs detecting the quantity of the suspended portion of each of the papers 2 and 3 when the papers 2 and 3 are conveyed by the pinching roller unit 8 by the length of the image printed on the most front side of the suspended portion of each of the papers 2 and 3, and comparing the detected quantity of the suspended portion with the predetermined value.

In the present case, therefore, the quantity of the suspended portion of the paper 3 when the leading end of the paper 3 is conveyed by the length of the image "D21: C type" printed on the most front side of the suspended portion of the paper 3, is detected. At the timing when it is confirmed that the quantity of the suspended portion is more than the predetermined value, switchover of the pinching roller unit 8 is executed. Therefore, as described above, the quantity of the suspended portion of the paper 3 is always kept more than the predetermined value.

Even while the leading end of the paper 3 is conveyed by the pinching roller unit 8 downstream of the cutting position in the cutting unit 9, the paper 3 upstream of the suspended-portion formation unit 7 is being conveyed by the conveyance roller unit 5. Thus, printing on the paper 3 by the inkjet printing unit 9 is continued without suspension. Therefore, the quantity of the suspended portion of the paper 3 immediately after the leading end of the paper 3 is conveyed as illustrated in FIG. 22 changes in accordance with the conveyance quantities of the paper 3 by the conveyance roller unit 5 and the pinching roller unit 8 at that time.

Figure 23:
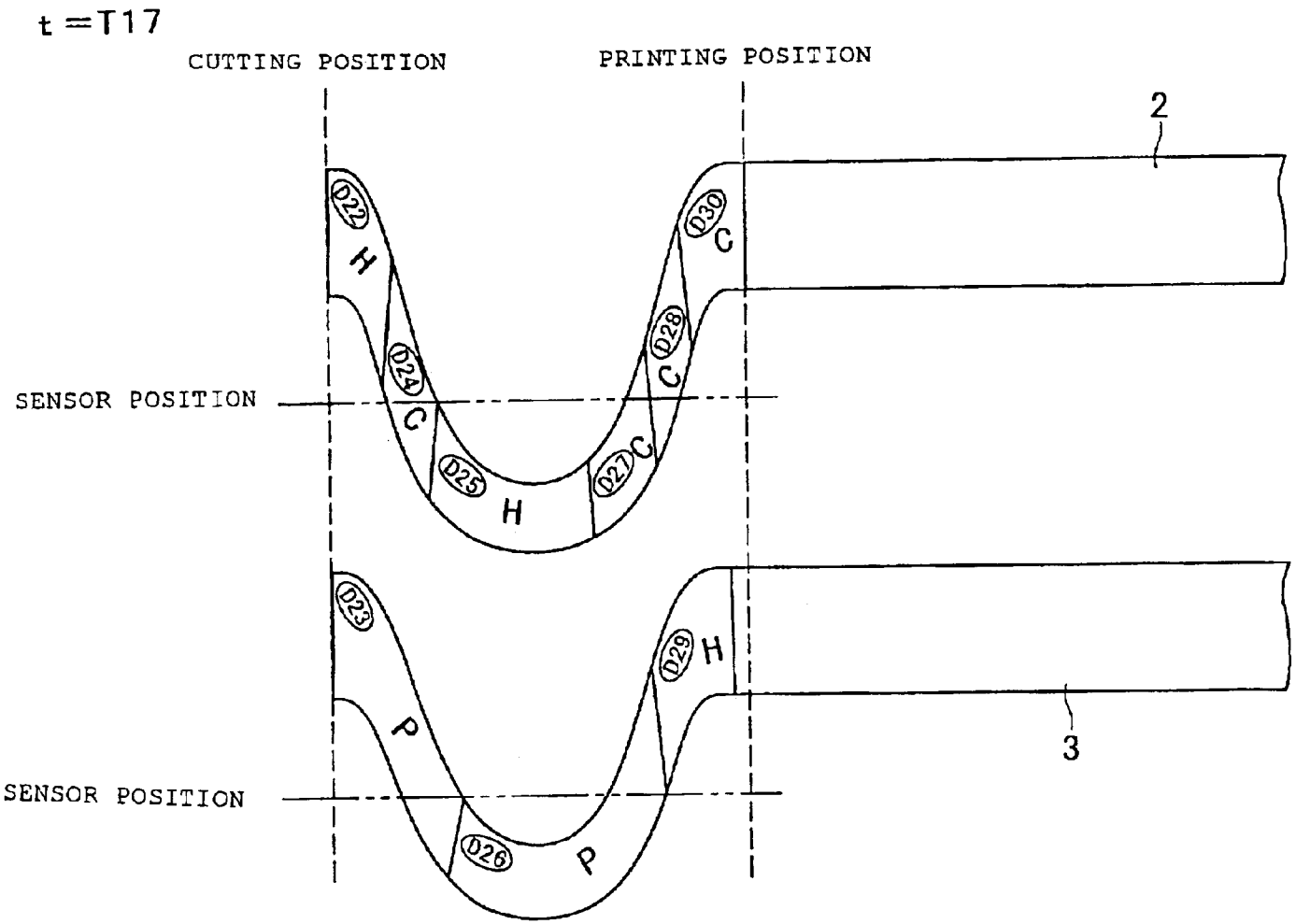
FIG. 23 is a schematic view illustrating a state of each paper in the vicinity of a suspended portion according to the second embodiment.

After this, when printing on the papers 2 and 3 is further continued, the quantity of the suspended portion of each of the papers 2 and 3 again increases gradually. When printing the sixth image "D30: C type" is completed on the paper 2, the lower end of the suspended portion of the paper 2 has reached a position lower than the sensor position corresponding to the photosensors 70 as illustrated in FIG. 23 (a state at time T17 in FIG. 16). At this time, on the paper 3, printing the fourth image "D29: H-type" is completed.

Figure 24:
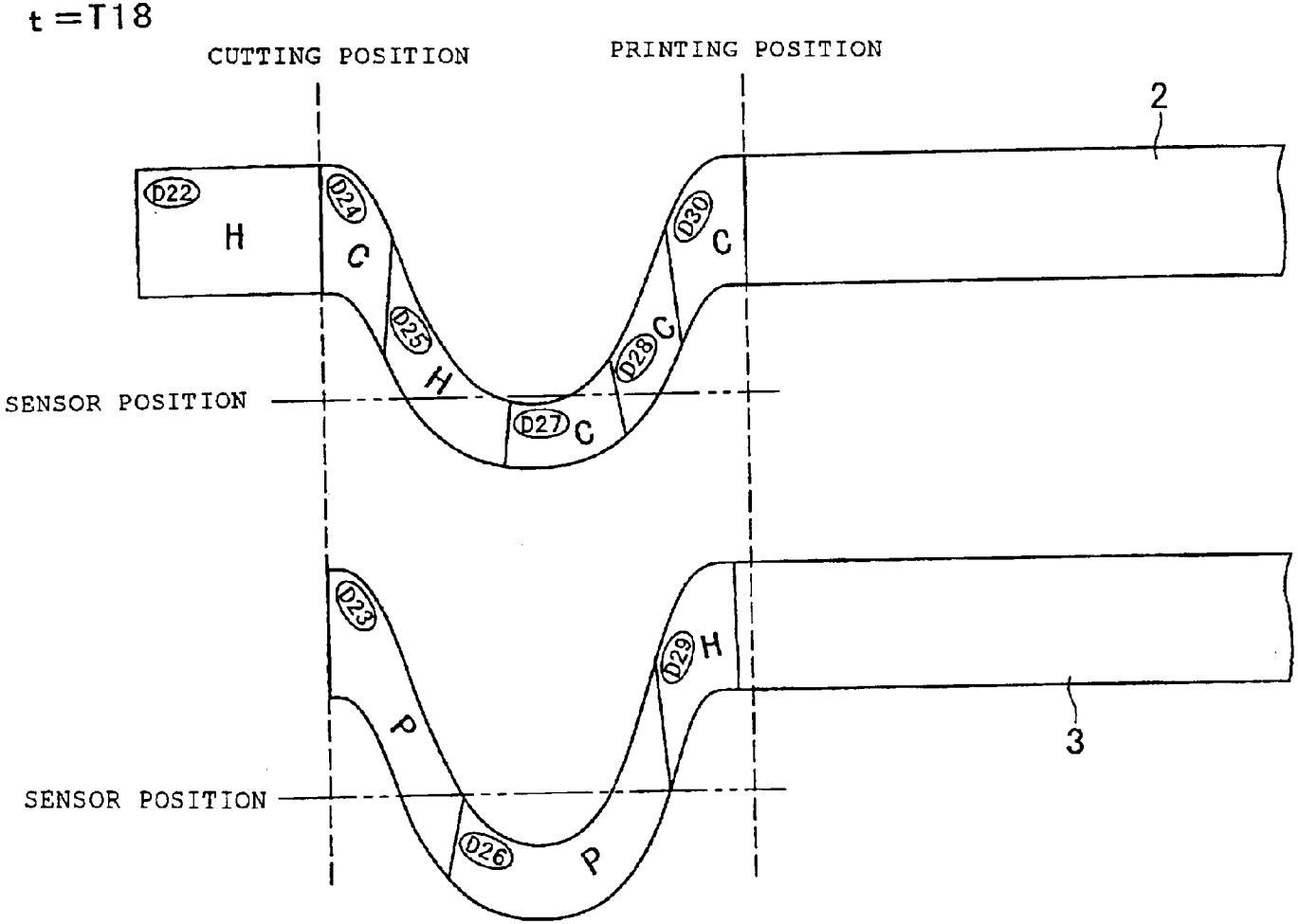
FIG. 24 is a schematic view illustrating a state of each paper in the vicinity of a suspended portion according to the second embodiment.

When the lower end of the suspended portion of the paper 2 has reached the position lower than the sensor position corresponding to the photosensors 70 and the quantity of the suspended portion of the paper 2 has sufficiently increased, that is, even when the leading end of the paper 2 has been conveyed by the length of the image "D22: H type" printed on the most front side of the suspended portion of the paper 2, immediately after it is confirmed that the quantity of the suspended portion of the paper 2 is kept more than the predetermined value, the pinching roller unit 8 is switched over from a state of holding both the papers 2 and 3 into a state of conveying the only paper 2 downstream (a state at time T18 in FIG. 16). As a result, as illustrated in FIG. 24, the leading end of the only paper 2 is conveyed downstream of the cutting position in the cutting unit 9 by the length of the image "D22: H type". The rear end of the image "D22: H type" is thereby brought at a position corresponding to the cutting position in the cutting unit 9 and the paper 2 is cut at the rear end of the image "D22: H type". Printing and cutting off the image "D22: H type" are thus completed. At the timing when the leading end of the paper 2 is conveyed by the length of the image "D22: H type", the pinching roller unit 8 is switched over from a state of conveying the paper 2 into a state of holding the paper 2.

As illustrated in FIG. 24, even after the paper 2 is conveyed by the length of the image "D22: H type", the lower end of the suspended portion of the paper 2 has reached the sensor position corresponding to the photosensors 70 and the quantity of the suspended portion of the paper 2 is kept more than the predetermined value.

Printing on the papers 2 and 3 is further continued, the quantity of the suspended portion of each of the papers 2 and 3 when the papers 2 and 3 are conveyed by the length of an image printed on the most front side of the suspended portion of each of the papers 2 and 3 is compared with the predetermined value, the controller 20 properly switches over the pinching roller unit 8, and then cutting off the images D23→D24→D25→. . . →D30 is performed. More specifically, every time when the quantity of the suspended portion of each of the papers 2 and 3 when the papers 2 and 3 are conveyed by the length of an image printed on the most front side of the suspended portion of each of the papers 2 and 3 exceeds the predetermined value, the controller 20 switches over each of the drive roller pairs 8*a* and 8*b* of the pinching roller unit 8 into a state of conveying each of the papers 2 and 3 downstream of the pinching roller unit 8, and cutting off the images D23 to D30 is performed.

In this embodiment, when each photosensor 70 does not detect any suspended portion of each of the papers 2 and 3, that is, when the lower end of the suspended portion of each of the papers 2 and 3 has not reached the sensor position corresponding to the photosensors 70, the drive roller pairs 8*a* and 8*b* of the pinching roller unit 8 are not switched over into a state of conveying the papers 2 and 3 downstream of the pinching roller unit 8.

The papers 2 and 3, on which the images D21 to D30 have been printed and which have been cut in the order of photographing of the images recorded on the film 200, are discharged one by one through the discharge port 30*a* of the casing 30. They are conveyed by the conveyor belt 80 and piled on the tray 85 in the order of being discharged.

After printing of all images subsequent to the image D30 recorded on the film 200 in this embodiment is completed, till those images are separated by cutting, the papers 2 and 3 may be conveyed without forming suspended portions and cut at the rear end of each image.

As described above, according to the ink-jet printer of this embodiment, images are allotted to and printed on each of the papers 2 and 3 such that the order of images printed on each of the papers 2 and 3 gradually increases toward the tail end of each of the papers 2 and 3. The papers 2 and 3 are then cut at the rear end of each image in the order of photographing. The papers 2 and 3 cut with the cutting unit 9 after each image is printed are then piled on the tray 85 in the order of photographing. Therefore, the papers 2 and 3 conveyed after the images are printed and then piled one on another are prevented from being rearranged in the order of photographing.

Besides, with forming a suspended portion of each of the papers 2 and 3 on which the images D21 to D30 have been printed, only one of the papers 2 and 3 can be conveyed downward of the pinching roller unit 8. Therefore, in case of printing images including images of "C type", "H type", and "P type" different in length, on the papers 2 and 3 in sequence, printing images by the ink-jet printing unit 6 may not be suspended and the papers 2 and 3 can be cut independently of each other. Thus, reduction of the processing performance of the ink-jet printer 1 can be prevented.

Further, images recorded on the film 200 are allotted in the order of photographing to one of the papers 2 and 3 in which the sum of the image lengths having been allotted to the paper is shorter than the other paper. Thus, the difference in consumption between the papers 2 and 3 is narrow. Therefore, the time necessary for the ink-jet printing unit 6 printing the images can be shortened. This can improve the processing performance of the ink-jet printer. In addition, since the papers 2 and 3 are substantially alternately cut in accordance with images printed on the suspended portions of the papers 2 and 3, the quantity of the suspended portion of each of the papers 2 and 3 is relatively small. Therefore, the space for receiving the suspended portion of each of the papers 2 and 3 can be made small. This can reduce the size of the ink-jet printer 1.

Further, the cutting unit 9 includes the movable and fixed cutting edges 9*a* and 9*b* each having its length extending over the papers 2 and 3. Therefore, any of the papers 2 and 3 can be cut with the pair of cutting edges at the rear end of each image. Thus, in comparison with a case wherein the cutting unit 9 includes a pair of cutting edges for each of the papers 2 and 3, produce of an excessive manufacture cost can be suppressed. Further, also to a wide paper having the same width as the whole width of the conveyance path of the papers 2 and 3, printing each image and cutting at the rear end of each image can properly be performed.

Figure 25:
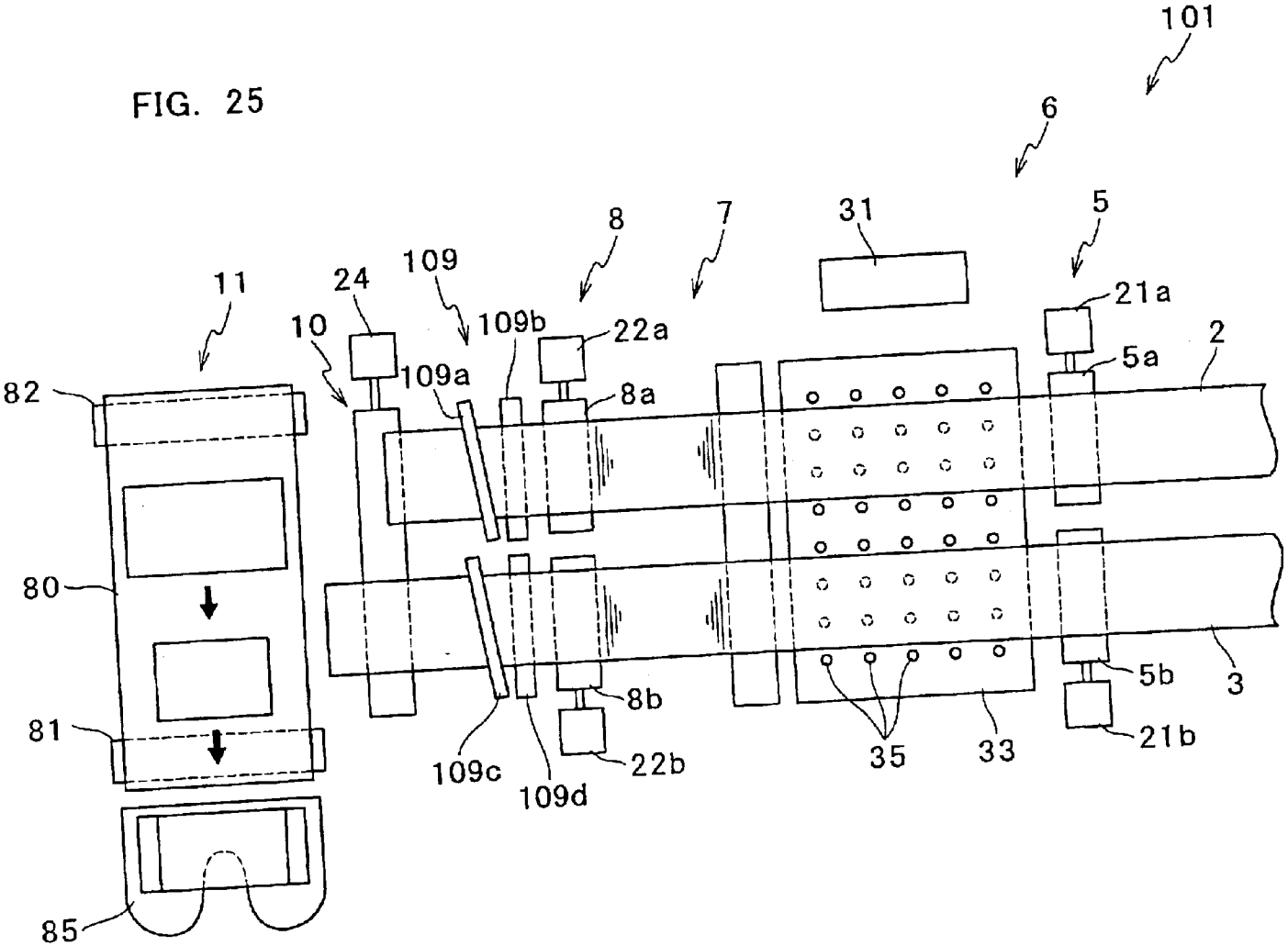
FIG. 25 is a plan view of an ink-jet printer according to a third embodiment of the present invention.

Next, a third embodiment of the present invention will be described with reference to FIG. 25.

An ink-jet printer 101 of the third embodiment differs from the ink-jet printer 1 of the first embodiment in the following feature. That is, the ink-jet printer 1 of the first embodiment is provided with the cutting unit 9 including the movable and fixed cutting edges 9*a* and 9*b* each having its length extending over the papers 2 and 3. Contrastingly, the ink-jet printer 101 of the third embodiment is provided with a cutting unit 109 including a movable cutting edge 109*a* and a fixed cutting edge 109*b* each having its length extending over the paper 2, and a movable cutting edge 109*c* and a fixed cutting edge 109*d* each having its length extending over the paper 3. The other construction of the ink-jet printer 101 of the third embodiment as illustrated in FIG. 25 is the same as that of the ink-jet printer 1 of FIG. 2. Therefore, in FIG. 25, the same components as in FIG. 2 are denoted by the same reference numerals as in FIG. 2, thereby omitting the description.

Also in the ink-jet printer 101 of this embodiment, printing images, cutting the papers 2 and 3 at the rear end of each image, and discharging the papers 2 and 3 on which images have been printed can be performed like the first and second embodiment.

In this embodiment, when the image allotment unit 20*b* allots images to each of the papers 2 and 3 like the first embodiment, the papers 2 and 3 may be cut substantially at the same time after the rear ends of images printed near the leading ends of the papers 2 and 3 are aligned at the cutting position in the cutting unit 109, or the papers 2 and 3 may be cut independently of each other at the rear end of each image in the order of photographing.

On the other hand, when the image allotment unit 20*b* allots images to each of the papers 2 and 3 like the second embodiment, the papers 2 and 3 are cut independently of each other with the cutting unit 109 at the rear end of each image in the order of photographing. In this case, either the movable and fixed cutting edges 109*a* and 109*b* for the paper 2 or the movable and fixed cutting edges 109*c* and 109*d* for the paper 3 is driven.

As described above, in the ink-jet printer 101 according to this embodiment, the cutting unit 109 includes a pair of cutting edges for each of the papers 2 and 3. Therefore, in comparison with a case wherein the cutting unit includes a pair of cutting edges each having its length extending over the papers 2 and 3, there is high possibility that the number of cutting operation of each pair of cutting edges for the paper is less. In addition, there is no occurrence of "cut the air" of cutting edges in one of the conveyance paths of the papers 2 and 3 as in a case wherein only one of the papers 2 and 3 is cut with cutting edges each having its length extending over the papers 2 and 3. Thus, reduction of the cutting performance and of the cutting edges for the papers 2 and 3 and the duration of the cutting edges or deterioration of the cutting edges are suppressed. As a result, the life of the cutting unit 109 can be elongated. Besides, in case of reducing the number of cutting operations of each pair of cutting edges for the papers 2 and 3, also an effect can be obtained that the noise upon the operation of the cutting unit 109 is reduced.

Hereinbefore, preferred embodiments of the present invention have been described. But, the present invention is not limited to the above-described embodiments. Various changes in design can be made therein. For example, in the above-described first embodiment, images are allotted in the order of photographing such that the order of an image to be printed in a predetermined order from the leading end of the papers 3 closer to the tray 85 is one smaller than that of the paper 2, and the order of images to be printed on each of the papers 2 and 3 gradually increases by twos toward the tail end of each of the papers 2 and 3. In the above-described second embodiment, images are allotted in the order of photographing to one of the papers 2 and 3 in which the sum of the image lengths having been allotted to the paper is shorter than the other paper. But, the present invention is not limited to those allotments. In any of the above-described embodiments, allotment of images by the image allotment unit 20*b* can be optionally changed as far as images are allotted to each of the papers 2 and 3 such that the order of images to be printed on each of the papers 2 and 3 gradually increases toward the tail end of each of the papers 2 and 3. Therefore, in the above-described second embodiment, for example, images may be allotted in the order of photographing so that the difference in image lengths having been allotted between the papers 2 and 3 is less than the length of a "P type" image.

Besides, in the above-described first to third embodiments, images are allotted to each of the papers 2 and 3 such that the order of images to be printed on each of the papers 2 and 3 gradually increases toward the tail end of each of the papers 2 and 3. But, the present invention is not limited to this allotment. In an modification, images may be allotted to each of the papers 2 and 3 such that the order of images to be printed on each of the papers 2 and 3 gradually decreases toward the tail end of each of the papers 2 and 3. Further, images may be allotted in the order of photographing such that the order of an image to be printed in a predetermined order from the leading end of the papers 3 closer to the tray 85 is one smaller than that of the paper 2, and the order of images to be printed on each of the papers 2 and 3 gradually decreases by twos toward the tail end of each of the papers 2 and 3. In these cases, the papers 2 and 3 cut with the cutting unit 9 after images are printed, are piled on the tray 85 such that the order of photographing decreases from the lower layer toward the upper layer. Therefore, also in this case, the papers 2 and 3 conveyed after the images are printed and then piled one on another are prevented from being rearranged in the order of photographing.

Further, in the above-described first to third embodiments, the quantity of the suspended portion of each of the papers 2 and 3 is controlled to be always kept more than a predetermined value. But, the quantity of the suspended portion of each paper may not always be kept more than the predetermined value. In addition, no suspended portion of each of the papers 2 and 3 may be formed. But, from the viewpoint of the processing performance of the ink-jet printer, it is preferable to form a suspended portion of each of the papers 2 and 3. Further, it is more preferable to always ensure the quantity of the suspended portion of each of the papers 2 and 3 so that the suspended portion does not disappear even after the next paper is conveyed. Even in case of always keeping the quantity of the suspended portion of the paper more than a predetermined value, the predetermined value can be set optionally. In case of setting the predetermined value for the quantity of the suspended portion of the paper, it is preferably set to a value in which an image is not deteriorated because the conveyance force by the pinching roller unit is transmitted to the ink-jet printing unit by the elasticity (nerve) of the paper.

Further, in the above-described first to third embodiments, a suspended portion is formed in either of the papers 2 and 3. But, a suspended portion may be formed in only one of the papers 2 and 3. As a case wherein a suspended portion is preferably formed in only one of the papers 2 and 3, there is a case wherein images are printed in sequence on one of the papers 2 and 3 for example.

Further, in the above-described first to third embodiments, the suspended-portion formation unit 7 is provided with the pressing members 61 and 62 which can apply force to the papers 2 and 3 so that the suspended portion of each of the papers 2 and 3 is always formed under the conveyance plane of the papers 2 and 3. But, the present invention is not limited to this construction. The construction of the suspended-portion formation unit can optionally be changed. For example, the suspended-portion formation unit may be provided with pressing members which can apply force to the papers so that the suspended portion of each of the papers is always formed over the conveyance plane of the papers. Besides, in place of such pressing members, suction means capable of sucking the papers may be provided. Further, such a suspended-portion formation unit need not always be provided. Without provision of such a suspended-portion formation unit, by controlling the conveyance roller unit and the pinching roller unit, a suspended portion of each paper may be formed under or over the conveyance plane of the paper.

Further, in the above-described first to third embodiments, printing is performed to the papers 2 and 3 having the same width and being conveyed in two lines. But, the present invention is not limited to this feature. Printing may be performed to papers being conveyed in three or more lines. Besides, the papers being conveyed in lines have different widths. Further, in case of a cutting unit provided with a pair of cutting edges extending over the papers 2 and 3, printing may be performed to a relatively wide paper being conveyed in a line in the conveyance path of the papers 2 and 3.

According to an aspect of the present invention, for example, when the number of record media is N (N: a natural number), on the record medium on the most downstream side in the conveyance direction in the sorter unit 11, the images in the order of 1, N+1, 2N+1, 3N+1, . . . , are recorded. On the record medium on the second most downstream side, the images in the order of 2, N+2, 2N+2, 3N+2, . . . , are recorded. On the record medium on the most upstream side, the images in the order of N, 2N, 3N, 4N, . . . , are recorded.

According to another aspect of the present invention, when the number of images is M (M: a natural number) and the number of record media is N (N: a natural number), on the record medium on the most downstream side in the conveyance direction in the sorter unit 11, the images in the order of M, M−N, M−2N, M−3N, . . . , are recorded. On the record medium on the second most downstream side, the images in the order of M-1, M−N−1, M−2N−1, M−3N−1, . . . , are recorded. On the record medium on the most upstream side, the images in the order of M−N+1, M−2N+1, M−3N+1, M−4N+1, . . . , are recorded.

Further, in the above-described first to third embodiments, printing is performed on the basis of image data in which images are recorded in the order of photographing. But, the present invention is not limited to this feature. The images may be in an optional sequence order. Further, in the above-described first to third embodiments, images include kinds of images different in length along the lengths of the papers 2 and 3. But, the present invention is not limited to this feature. All images may have the same length along the lengths of the papers 2 and 3.

Further, in the above-described first embodiment, the rear ends of the images printed near the leading ends of the papers 2 and 3 are aligned at the cutting position in the cutting unit 9 and the papers 2 and 3 are cut with the cutting unit 9 substantially at the same time. But, the papers 2 and 3 need not always be cut substantially at the same time. The papers 2 and 3 may be cut independently of each other at the rear end of each image printed near the leading end of each of the papers 2 and 3 in the order of photographing.

Further, in the above-described second embodiment, the papers 2 and 3 are cut independently of each other at the rear end of each image printed near the leading end of each of the papers 2 and 3 in the order of photographing. But, the papers 2 and 3 need not always be cut independently of each other. In case that images are allotted such that the order of an image to be printed near the leading end of the paper 3 closer to the tray 85 is one smaller than that of the paper 2, the papers 2 and 3 may be cut with the cutting unit 9 substantially at the same time after the rear ends of the images printed near the leading ends of the papers 2 and 3 are aligned at the cutting position in the cutting unit 9.

Further, in the above-described first embodiment, the papers 2 and 3 are cut substantially at the same time (plural lines cut). In the above-described second embodiment, the papers 2 and 3 are cut independently of each other (single line cut). But, the cutting unit is so constructed that the papers 2 and 3 can be cut by either of plural lines cut and single line cut. For example, in accordance with the print processing conditions of whether images of print types different in size from one another exist together or does not exist together, the cutting unit may be able to be switched over between plural lines cut and single line cut.

Further, in the above-described first to third embodiments, there are provided the conveyance roller unit 5 disposed upstream of the suspended portions of the papers 2 and 3 and the pinching roller unit 8 disposed downstream of the suspended portions of the papers 2 and 3, and both can convey each of the papers 2 and 3 independently of each other. But, the present invention is not limited to this construction. Any construction can be adopted for conveying the papers.

Further, in the above-described first to third embodiments, the photosensors 70 are provided detectable whether the quantity of the suspended portion of each of the papers 2 and 3 has reached a predetermined value. But, such a photosensor need not always be provided. In case of providing a photosensor, however, the quantity of the suspended portion of each paper can be detected more surely. Therefore, when there is no margin in the suspended portion, the paper can be prevented from being conveyed from the suspended portion toward the cutting position.

Further, in the above-described first to third embodiments, the ink-jet printers for printing on the papers 2 and 3 have been described. But, the present invention is not limited to such ink-jet printers. For example, the present invention may be an image recording apparatus other than ink-jet printers, such as a photograph processing apparatus in which a photographic paper is exposed to form a latent image.

What is claimed is:

1. An image recording apparatus comprising:

an image recording unit capable of recording images on a plurality of record media neighboring each other, said record media each having a long shape;

first conveyance means capable of conveying said plurality of record media independently of each other, said record media being disposed in parallel with each other;

a cutting unit disposed downstream of said image recording unit, said cutting unit being capable of cutting said plurality of record media being conveyed by said first conveyance means;

image allotment means for allotting images to each of said record media such that an order of images to be recorded on each of said record media gradually increases toward a tail end of each of said record media when a plurality of images to be recorded on said plurality of record media are in a predetermined sequence order;

second conveyance means for conveying said record media cut by said cutting unit, in a direction crossing a conveyance direction by said first conveyance means; and conveyance control means for controlling said first conveyance means such that said order of images recorded on each of said record media being conveyed by said second conveyance means and having reached a predetermined position increases one by one in the order of said record media having reached said predetermined position.

2. The image recording apparatus according to claim 1, wherein said image allotment means allots images to each of said record media such that said order of images to be recorded on each of said record media increases by the numbers of record media toward said tail end of each of said record media, and said order of images to be recorded in a predetermined order from a leading end of each of said record media increases one by one from a record medium on a downstream side in the conveyance direction by said second conveyance means to a record medium on an upstream side.

3. The image recording apparatus according to claim 1, wherein said plurality of images to be recorded in sequence on said plurality of record media by said image recording unit include a plurality of kinds of images different from each other in length along lengths of said record media, and said image allotment means allots images to each of said record media such that the maximum difference in consumption between said record media is not more than the length of an image that is the longest one of said plurality of kinds of images along said lengths of said record media.

4. The image recording apparatus according to claim 1, wherein said first conveyance means can form a suspended portion in each of said record media between said image recording unit and said cutting unit and includes detection means for detecting a quantity of suspended portion of each of said record media, and said conveyance control means controls said first conveyance means on the basis of detection results of said detection means such that each of said record media has a suspended portion and a state wherein each of said record media is conveyed from said suspended portion toward said cutting unit and a state wherein each of said record media is not conveyed from said suspended portion toward said cutting unit can be switched over.

5. The image recording apparatus according to claim 1, wherein said cutting unit includes a cutting edge extending over said plurality of record media being conveyed by said first conveyance means.

6. The image recording apparatus according to claim 1, wherein said cutting unit includes a cutting edge for each of said record media being conveyed by said first conveyance means.

7. An image recording apparatus comprising:

an image recording unit capable of recording images on a plurality of record media neighboring each other, said record media each having a long shape;

first conveyance means capable of conveying said plurality of record media independently of each other, said record media being disposed in parallel with each other;

a cutting unit disposed downstream of said image recording unit, said cutting unit being capable of cutting said plurality of record media being conveyed by said first conveyance means;

image allotment means for allotting images to each of said record media such that an order of images to be recorded on each of said record media gradually decreases toward a tail end of each of said record media when a plurality of images to be recorded on said plurality of record media are in a predetermined sequence order;

second conveyance means for conveying said record media cut by said cutting unit, in a direction crossing a conveyance direction by said first conveyance means; and conveyance control means for controlling said first conveyance means such that said order of images recorded on each of said record media being conveyed by said second conveyance means and having reached a predetermined position decreases one by one in the order of said record media having reached said predetermined position.

8. The image recording apparatus according to claim 7, wherein said image allotment means allots images to each of said record media such that said order of images to be recorded on each of said record media decreases by the numbers of record media toward said tail end of each of said record media, and said order of images to be recorded in a predetermined order from a leading end of each of said record media decreases one by one from a record medium on a downstream side in the conveyance direction by said second conveyance means to a record medium on an upstream side.

9. The image recording apparatus according to claim 7, wherein said plurality of images to be recorded in sequence on said plurality of record media by said image recording unit include a plurality of kinds of images different from each other in length along lengths of said record media, and said image allotment means allots images to each of said record media such that the maximum difference in consumption between said record media is not more than the length of an image that is the longest one of said plurality of kinds of images along said lengths of said record media.

10. The image recording apparatus according to claim 7, wherein said first conveyance means can form a suspended portion in each of said record media between said image recording unit and said cutting unit and includes detection means for detecting a quantity of suspended portion of each of said record media, and said conveyance control means controls said first conveyance means on the basis of detection results of said detection means such that each of said record media has a suspended portion and a state wherein each of said record media is conveyed from said suspended portion toward said cutting unit and a state wherein each of said record media is not conveyed from said suspended portion toward said cutting unit can be switched over.

11. The image recording apparatus according to claim 7, wherein said cutting unit includes a cutting edge extending over said plurality of record media being conveyed by said first conveyance means.

12. The image recording apparatus according to claim 7, wherein said cutting unit includes a cutting edge for each of said record media being conveyed by said first conveyance means.

13. An image recording apparatus comprising:

an image recording unit capable of recording images on a plurality of record media neighboring each other, said record media each having a long shape;

conveyance means capable of conveying said plurality of record media independently of each other, said record media being disposed in parallel with each other;

a cutting unit disposed downstream of said image recording unit, said cutting unit including a cutting edge extending over said plurality of record media; and conveyance control means for controlling said conveyance means such that rear ends of images recorded on the most front portion of at least two of said plurality of record media are aligned at a cutting position by said cutting unit and at this time, leading ends of the remaining record media are upstream of said cutting position when said image recording unit records a plurality of images in sequence and said plurality of images include a plurality of kinds of images different in length along lengths of said record media.

14. The image recording apparatus according to claim 13, wherein said conveyance control means controls said conveyance means such that rear ends of all images recorded on the most front portion of said plurality of record media are aligned at said cutting position by said cutting unit when said image recording unit records a plurality of images in sequence and said plurality of images include a plurality of kinds of images different in length along lengths of said record media.

15. The image recording apparatus according to claim 13, further comprising image allotment means for allotting images to each of said record media such that the numbers of images to be recorded on said plurality of record media are the same or the maximum difference in the number of images to be recorded between said plurality of record media is one.

16. The image recording apparatus according to claim 15, wherein said plurality of record media cut by said cutting unit are conveyed in a direction crossing a conveyance direction by said conveyance means, said plurality of images are in a predetermined sequence order, and said image allotment means allots images to each of said record media such that an order of images to be recorded on each of said record media increases by the numbers of record media toward a tail end of each of said record media, and said order of images to be recorded in a predetermined order from said leading end of each of said record media increases one by one from a record medium on a downstream side in said crossing direction to a record medium on an upstream side.

17. The image recording apparatus according to claim 13, wherein said conveyance means can form a suspended portion in each of said record media between said image recording unit and said cutting unit and includes detection means for detecting a quantity of suspended portion of each of said record media, and said conveyance control means controls said conveyance means on the basis of detection results of said detection means such that each of said record media has a suspended portion and a state wherein each of said record media is conveyed from said suspended portion toward said cutting unit and a state wherein each of said record media is not conveyed from said suspended portion toward said cutting unit can be switched over.

18. The image recording apparatus according to claim 17, further comprising suspended-portion formation auxiliary means for applying forces to said plurality of record media between said image recording unit and said cutting unit such that suspended portions are formed always in the same direction relative to a conveyance path of said plurality of record media.

19. The image recording apparatus according to claim 17, wherein said conveyance means includes a first conveyance unit disposed upstream of suspended portions and a second conveyance unit disposed downstream of said suspended portions, and either of said first and second conveyance units can convey said plurality of record media independently of each other.

20. An image recording apparatus comprising:

an image recording unit capable of recording images on a plurality of record media neighboring each other, said record media each having a long shape;

conveyance means capable of conveying said plurality of record media in parallel with each other, said conveyance means further being capable of forming a suspended portion of each of said record media downstream of said image recording unit when said image recording unit records a plurality of images in a sequence and said plurality of images include a plurality of kinds of images different in length along lengths of said record media;

a cutting unit disposed downstream of suspended portions of said record media, said cutting unit including a cutting edge extending over said plurality of record media being conveyed by said conveyance means;

detection means for detecting a quantity of said suspended portion of each of said record media; and conveyance control means for controlling said conveyance means on the basis of detection results of said detection means such that each of said record media has a suspended portion, one of said record media is conveyed from its suspended portion toward said cutting unit, and the others of said record media are not conveyed from their suspended portions toward said cutting unit.

21. The image recording apparatus according to claim 20, wherein said apparatus further comprises image allotment means for allotting images to each of said record media such that an order of images to be recorded on each of said record media gradually increases toward a tail end of each of said record media when said plurality of images are in a predetermined sequence order, and said conveyance control means controls said conveyance means such that images are sent to said cutting unit in said order.

22. The image recording apparatus according to claim 21, wherein said image allotment means allots images to each of said record media such that the maximum difference in consumption between said record media is not more than the length of an image that is the longest one of said plurality of kinds of images along said lengths of said record media.

23. The image recording apparatus according to claim 21, wherein said image allotment means allots images to each of said record media in said order such that the next image is recorded on the record medium in which the sum of lengths of images along the length of said record medium having been allotted to said record medium is the shortest among said plurality of record media.

24. The image recording apparatus according to claim 20, further comprising suspended-portion formation auxiliary means for applying forces to said plurality of record media between said image recording unit and said cutting unit such that suspended portions are formed always in the same direction relative to a conveyance path of said plurality of record media.

25. The image recording apparatus according to claim 20, wherein said conveyance means includes a first conveyance unit disposed upstream of suspended portions and a second conveyance unit disposed downstream of said suspended portions, and either of said first and second conveyance units can convey said plurality of record media independently of each other.

* * * * *